United States Patent [19]

Giras et al.

[11] 4,025,765

[45] May 24, 1977

[54] SYSTEM AND METHOD FOR OPERATING A STEAM TURBINE WITH IMPROVED CONTROL INFORMATION DISPLAY

[75] Inventors: Theodore C. Giras, Pittsburgh, Pa.; Leaman Podolsky, Wilmington, Del.

[73] Assignee: Westinghouse Electric Corporation, Pittsburgh, Pa.

[22] Filed: Aug. 10, 1973

[21] Appl. No.: 387,578

Related U.S. Application Data

[63] Continuation of Ser. No. 247,881, April 26, 1972, abandoned.

[52] U.S. Cl. ..... 235/151.21; 290/40 R; 60/646; 444/1

[51] Int. Cl.[2] ..... G05B 15/00; G06F 15/06; G06F 15/56

[58] Field of Search ..... 235/151.21, 151, 151.3; 290/40, 40.2, 2; 60/73, 105, 39.28 R, 646; 415/15, 17, 13, 1; 340/172.5; 444/1

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |

OTHER PUBLICATIONS

Application of the Prodac 50 System to Direct Digital Control, J. C. Belz, G. J. Kirk & P. S. Radcliffe, IEEE Intl. Conv. Rec. Part 3, 1965, pp. 102–122.

Monitoring and Automatic Control in Steam Power Stations by Process Computer, E. Doetsch & G. Hirschberg, Siemens Review XXXV(1968) No. 12, pp. 471–476.

*Primary Examiner*—Eugene G. Botz
*Assistant Examiner*—Edward J. Wise
*Attorney, Agent, or Firm*—E. F. Possessky

[57] ABSTRACT

A steam turbine control system includes an operator panel and a digital computer which operates the turbine valves through an electrohydraulic control. Turbine speed and load signals and valve position signals are coupled to the computer for use by the computer control loops in developing valve control signals. Two separate displays are provided on the operator panel, one for the speed or load reference and the other for the speed or load demand. Dedicated pushbuttons on the panel enable certain other parameters such as acceleration or load rate or valve position limit to be displayed in the reference display, while other pushbuttons can be used to address and display in the reference or demand display general control system parameters. A mechanism is provided for entering changes into the computer for the various parameters and for displaying such changes in one of the displays.

13 Claims, 27 Drawing Figures

| Pushbutton | IPBX | Function |
|---|---|---|
| REF | 1 | Display REFERENCE in REF windows and DEMAND in DMD windows |
| ACCEL RATE | 2 | Display ACCELERATION RATE in REF windows and clear DMD windows |
| LOAD RATE | 3 | Display LOAD RATE in REF windows and clear DMD windows |
| LOW LIMIT | 4 | Display LOW LOAD LIMIT in REF windows and clear DMD windows |
| HIGH LIMIT | 5 | Display HIGH LOAD LIMIT in REF windows and clear DMD windows |
| VALVE POSITION LIMIT | 6 | Display VALVE POSITION LIMIT in REF windows and governor valve variable being limited in DMD windows |
| PARAMETER DISPLAY | 7 | Initiate display of internal control system variable; see operating instructions |
| VALVE STATUS | 8 | Initiate display of valve position; see operating instructions |

FIG. 11

SYSTEM AND METHOD FOR OPERATING A STEAM TURBINE WITH IMPROVED CONTROL INFORMATION DISPLAY

This is a continuation, of application Ser. No. 247,881 filed Apr. 26, 1972, now abandoned.

CROSS-REFERENCE TO RELATED APPLICATIONS

1. Ser. No. 722,779, entitled "Improved System and Method for Operating a Steam Turbine and an Electric Power Generating Plant" filed by Theodore C. Giras and Manfred Birnbaum on Apr. 4, 1968, assigned to the present assignee, and continued as Ser. No. 124, 993 on Mar. 16, 1971, and Ser. No. 319,115, on Dec. 29, 1972.

2. Ser. No. 408,962, entitled "System and Method for Starting, Synchronizing and Operating a Steam Turbine with Digital Computer Control" filed as a continuation of Ser. No. 247,877 which had been filed by Theodore C. Giras and Robert Uram on Apr. 26, 1972, assigned to the present assignee and hereby incorporated by reference; other related cases are set forth in Ser. No. 408,962.

BACKGROUND OF THE INVENTION

The present invention relates to steam turbine control systems and more particularly to the display of control information for operator control purposes.

There have been various display arrangements provided for steam turbine control systems in electric power plants. Typically, these arrangements have been provided to display important quantities that were readily and economically detectable in the control equipment. Usually, particular quantities such as speed reference or demand have been exclusively associated with particular displays.

Computer systems have been applied in various applications where the more flexible display capability of a computer could be economically employed to provide extensive control information display. However, there is no known prior application of a control computer for relatively direct control of valve position and other turbine variables and for extended control information display for such a control. The present application is directed to such a turbine control system having extended information display provided in an efficient and economic matter.

The description of prior art herein is made on good faith and no representation is made that any prior art considered is the best pertaining prior art nor that the interpretation placed on it is unrebuttable.

SUMMARY OF THE INVENTION

A steam turbine control system comprises a speed and load control having predetermined turbine process signals applied to it and being structured to generate output signals for positioning the turbine valves. The control system also includes an operator panel coupled to the speed and load control, and it includes at least two display means respectively for the reference and demand values of speed or load and further selectively for various other system parameters. Display signals generated by the control and selectively applied to the display means provide for the selected display. Control information is accordingly provided efficiently and economically for improved operator control of the turbine.

BRIEF DESCRIPTION OF THE DRAWINGS

FIG. 11 is a table of display buttons which is operable in accordance with the principles of the invention;

DESCRIPTION OF THE PREFERRED EMBODIMENT

A. POWER PLANT

Figure 1:
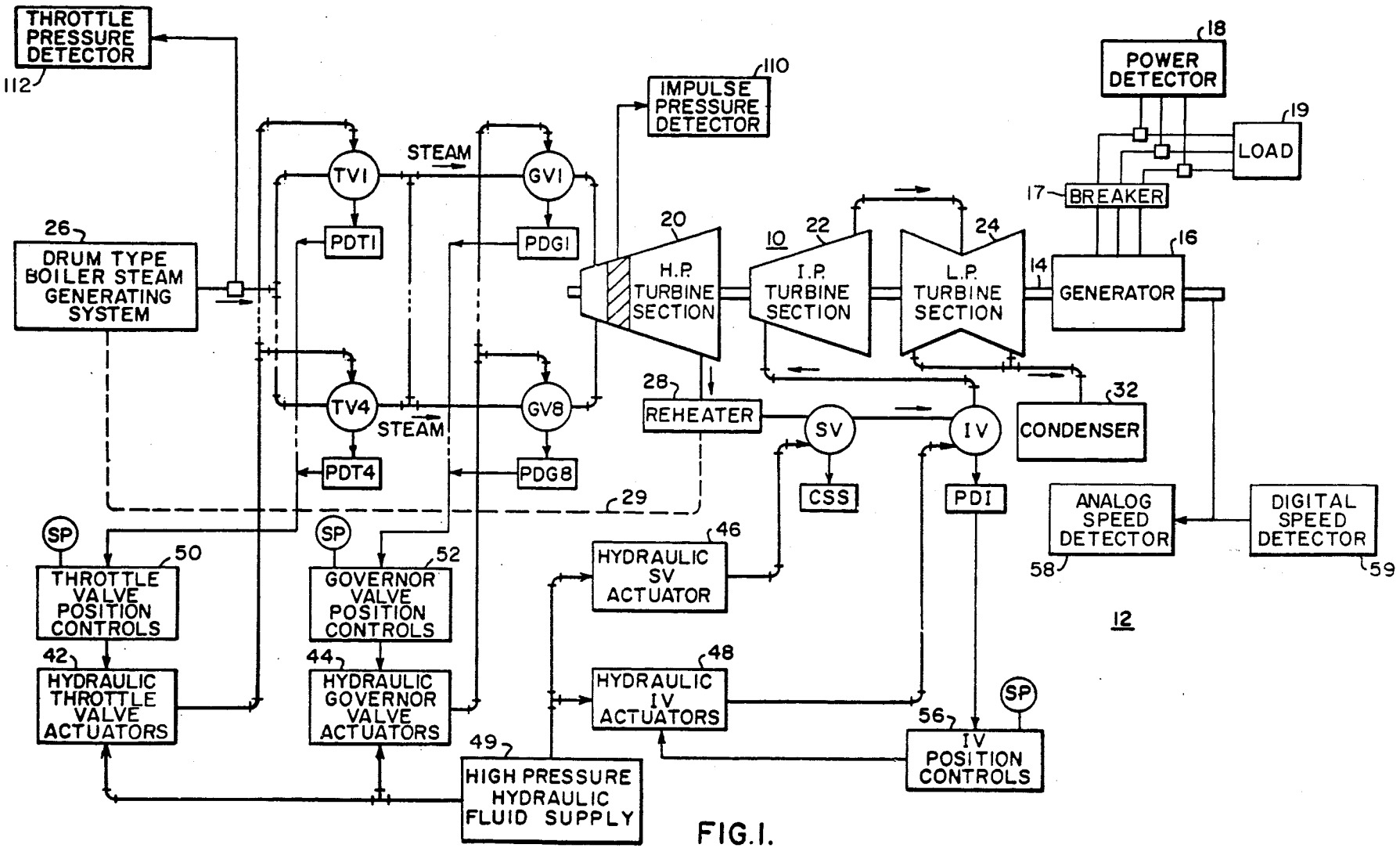
FIG. 1 shows a schematic diagram on an electric power plant including a large steam turbine and a fossile fuel fired drum type boiler and control devices which are all operable in accordance with the principles of the invention.
Figure 2:
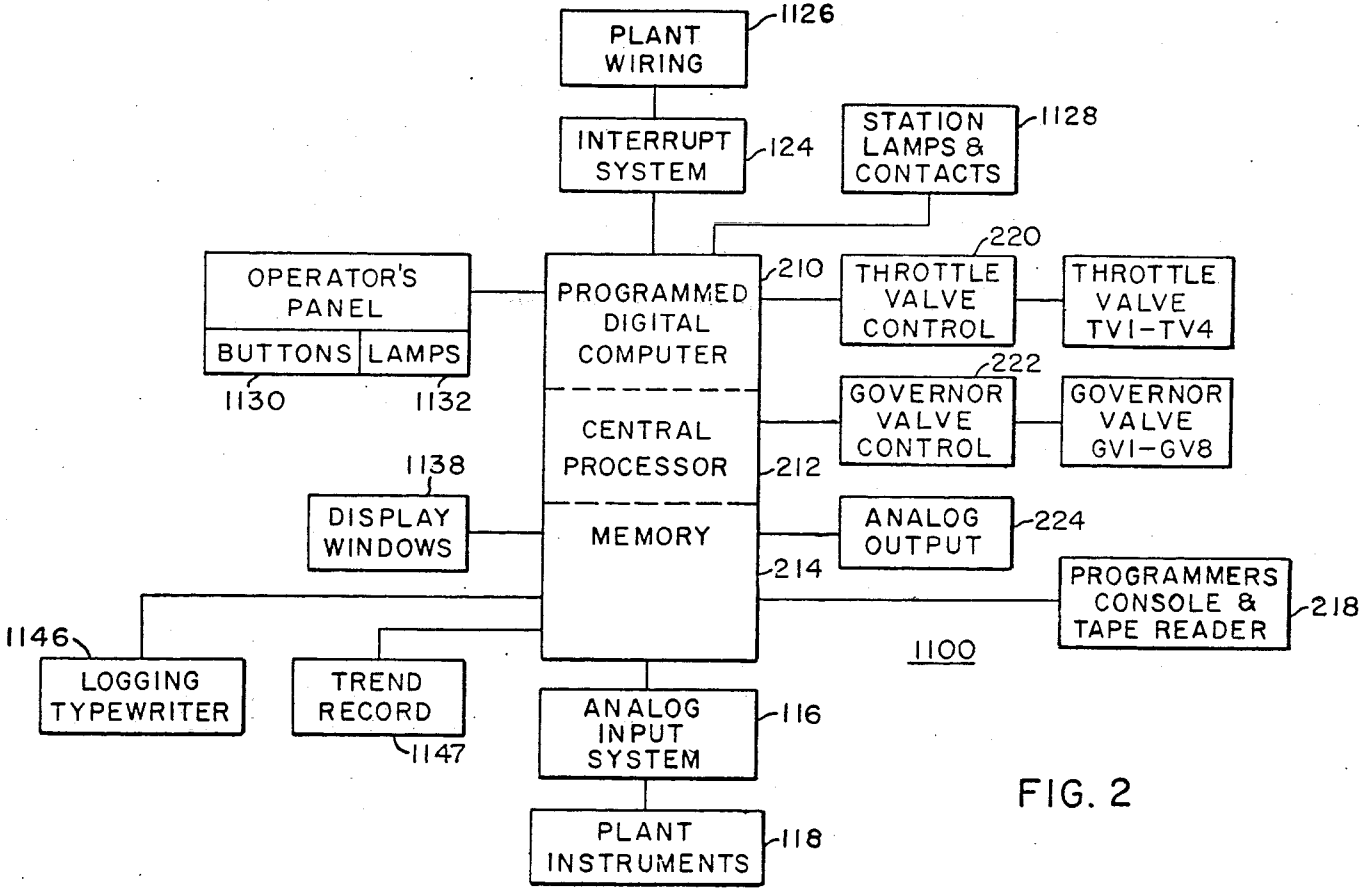
FIG. 2 shows a schematic diagram on a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be affected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1—TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1–GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1–TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV 4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 260° periphery of the turbine high pressure casing and that they are numbered consecutively around the periphery so that the inlets corresponding to the governor valves GV1 and GV8 are arcuately adjacent to each other.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position conventional analog controller (not shown in FIG. 1) which drives a suitably known actuator servo valve (not indicated) in the well known manner. The reheat stop valve actuators 46 are fully open unless the conventional trip system or other operating means causes them to close and stop the reheat steam flow.

Since the turbine power is proportional to steam flow under the assumed control condition of substantially constant throttle pressure, steam valve positions are controlled to produce control over steam flow as in intermediate variable and over turbine space and/or load as an end control variable or variable or variables. Actuator operation provides the steam valve positioning, and respective valve position detectors PDT1–PDT4, PDT4, PDG1–PDG8 and PDI are provided to generate respective valve position feedback signals for deleloping position signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect position setpoint signals SP in developing the respective input error signals. Position controlled operation of the interceptor valving IV would typically be provided only under a reheat steam flow cutback requirement.

A speed detector 58 is provided for determining the turbine shaft speed for speed control and for frequency participation control purposes. The speed detector 58 can for example be in the form of a reluctance pickup (not shown) magnetically could to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1–PDT4, PDT4, PDG1–PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH - COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electrical Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine conrol functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operated by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. A detailed list of all parameters is provided in Appendix 1. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A loging typewriter 1146 is provided for logging printouts of various monitored parameters as well as alarms generated by an automatic turbine startup system (ATS) which includes program system blocks 1140, 1142, 1144 (FIG. 6) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive progrm. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status diaplay lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3A:
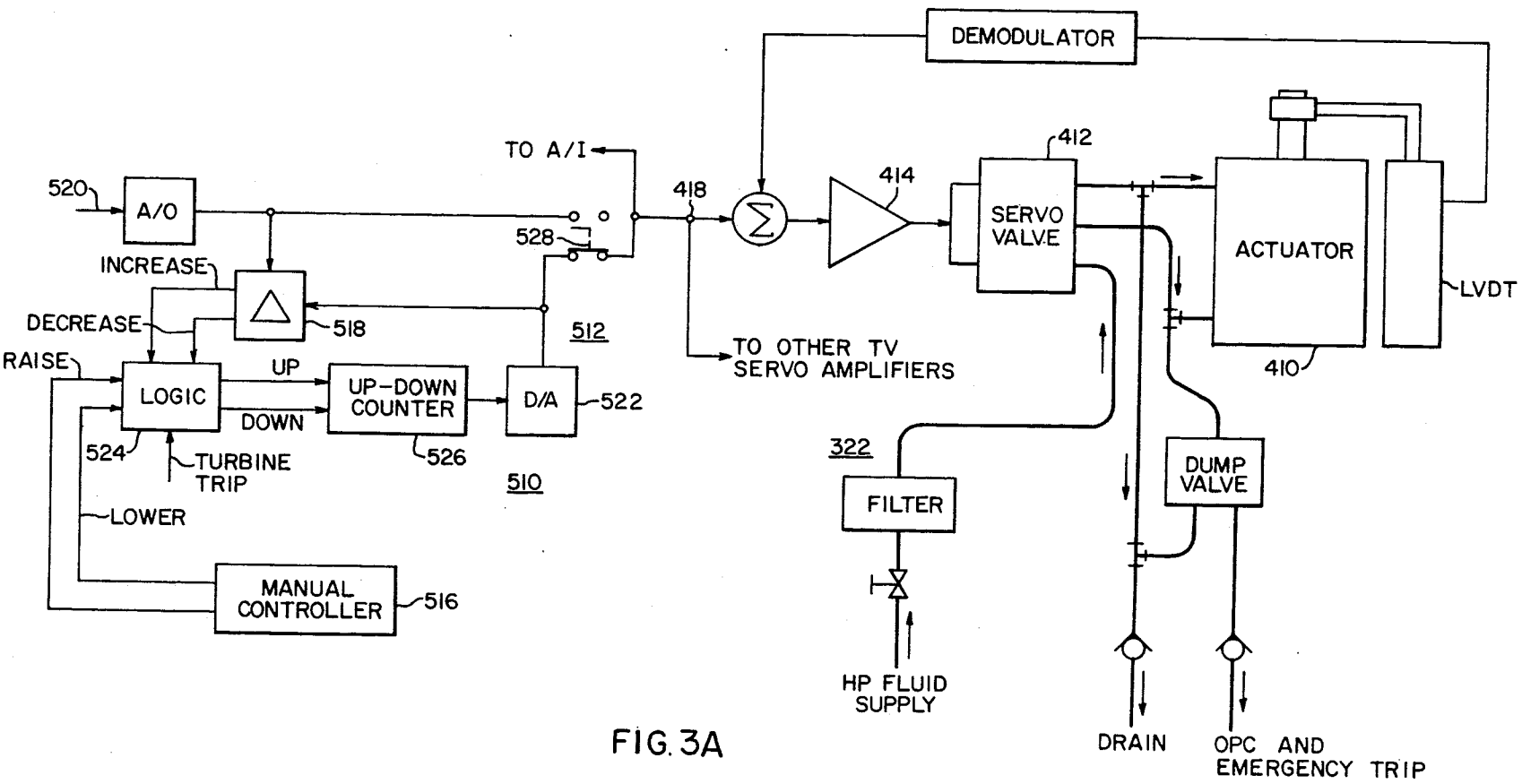
FIGS. 3A, 3B and 3C show a schematic diagram of a hybrid interface between a manual backup system and the digital computer connected with the servo system controlling the valve actuators.
Figure 3B:
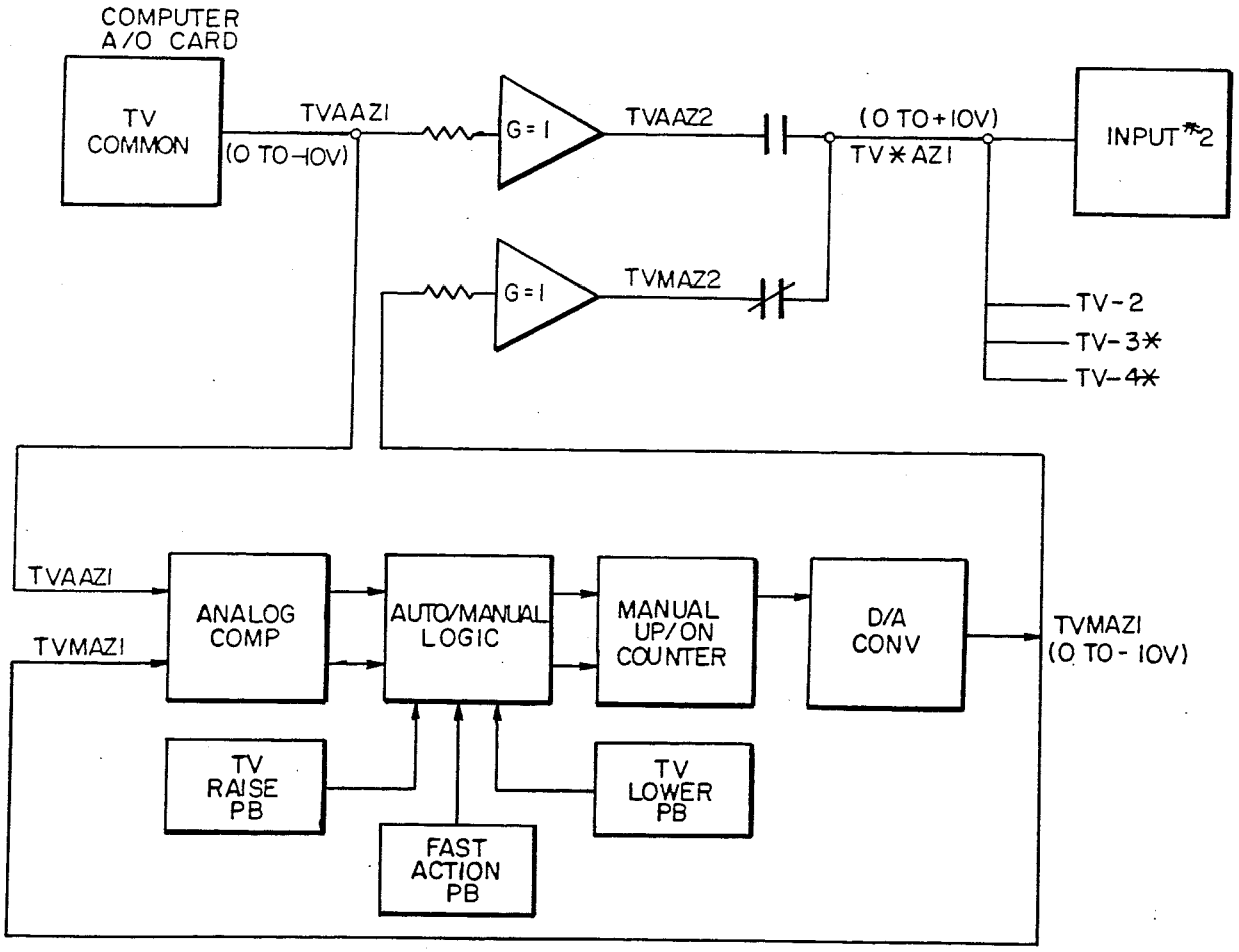
Figure 3C:
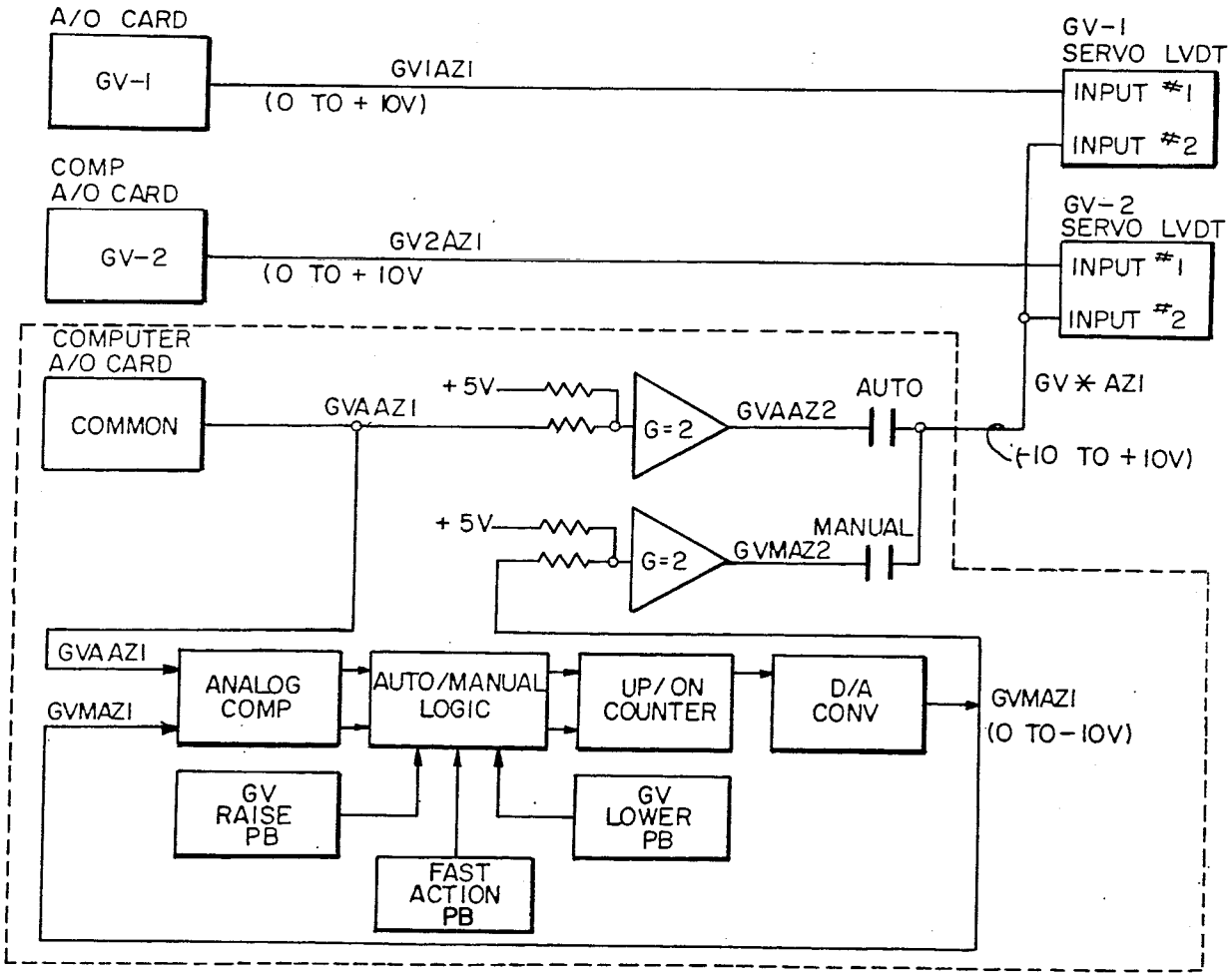

Making reference now to FIGS. 3A–3C, a hardwired digital/analog system forms a part of the DEH control system 1100 (FIG. 2). Structurally, it embraces elements which are included in the blocks 50, 52, 42 and 44 of FIG. 1 as well as additional elements. A hybrid interfact 510 is included as a part of the hardwired system. The hybrid interface 510 is connected to actuator system servo-amplifiers 414 for the various steam valves which in turn are connected to a manual controller 516, an overspeed protection controller, not shown, and redundant DC power supplies, not shown.

A controller shown in FIG. 3A is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks single valve analog outputs 520 from the digital computer 210. A comparator 518 compares a signal from a digital-to-analog converter 522 of the manual system with the signal 520 from the digital computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual conroller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

Figure 4:
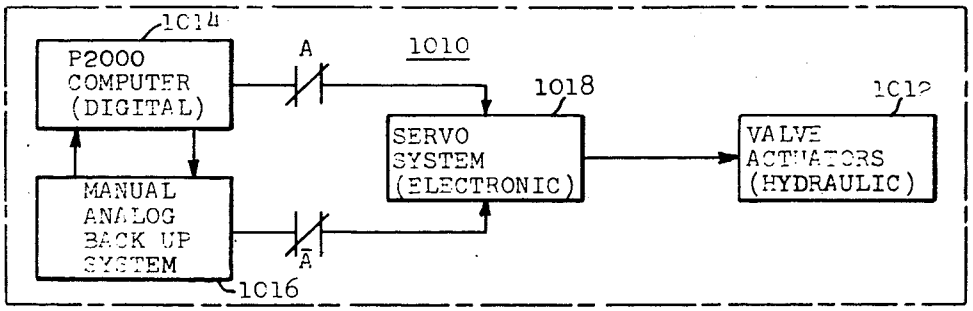
FIG. 4 shows a simplified block diagram of the digital Electrol Hydraulic Control System in accordance with the principle of the invention.

With reference now to FIG. 4, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention. More functional detail on various programs is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input-/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other progrms to be described in greater detail subsequently herein.

Figure 5:
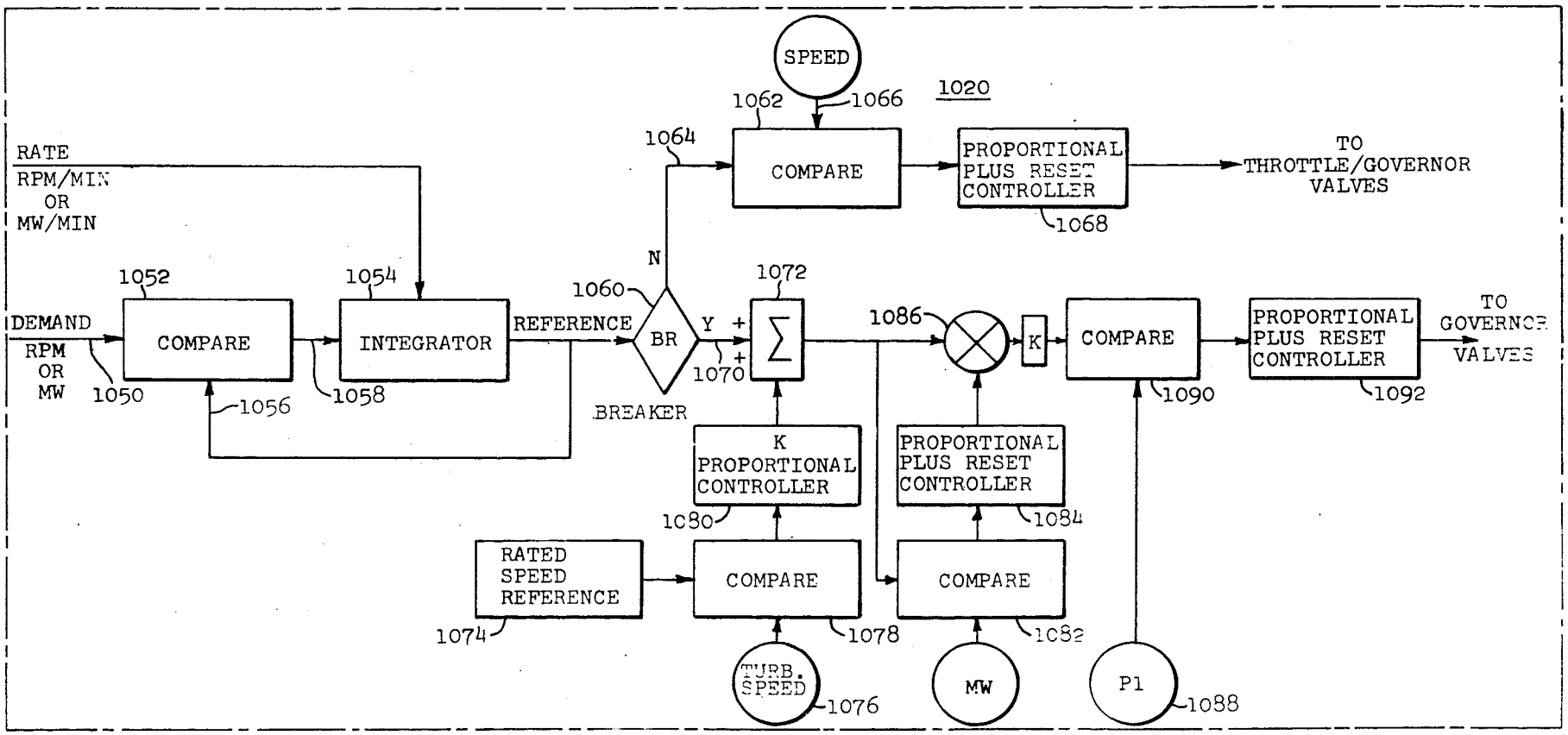
FIG. 5 shows a block diagram of a control program used in accordance with the principles of the invention.

With reference now to FIG. 5, a functional control loop diagram in its preferred form includes the CONTROL task or program 1020 which is executed in the computer 1010. Inputs representing demand and rate provide the desired turbine operating setpoints. The demand is typically either the target speed in specified revolution per minute of the turbine systems during startup or shutdown operations the target load in megawatts of electrical output to be produced by the generating system 16 during load operations. The demand enters the block diagram configuration of FIG. 5 at the input 1050 of a compare block 1052.

The rate input either in specified RPM per minute or specified megawatts per minute, depending upon which input is to be used in the demand function, is applied to an integrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 then makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the conrol task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a "two signal" speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then ran through a proportional plus reset controller represented by program box 1084 to generate a feedback megawatt trim.

The feedforward speed compensated reference is trimmed by the megawatt feedback error multiplicatively to correct load mismatch, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset conroller function 1092.

During load control the megawatt loop comprising in part blocks 1082 and 1084 may be switched out of service leaving the speed loop 1310 and an impulse pressure loop operative in the DEH system 1100.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1–GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Figure 6:
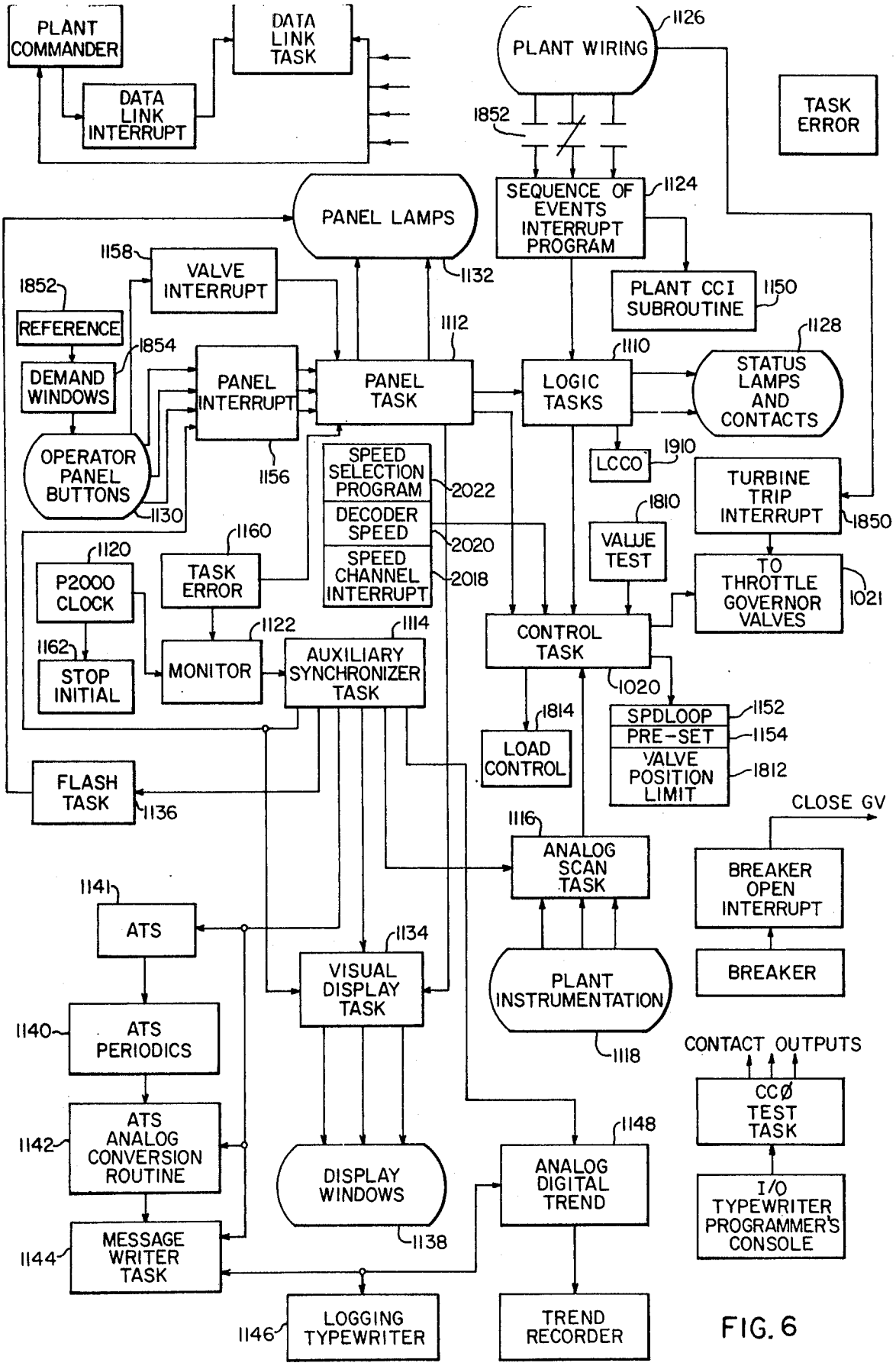
FIG. 6 shows a block diagram of the programs and subroutines of the digital Electro Hydraulic and the automatic turbine startup and monitoring program in accordance with the principles of the invention.

Making reference to FIG. 6, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are registered with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states according to predetermined conditions and transmits this data to the control program 1020 where this information is utilized in determining the positioning control action for the throttle valves TV1–TV4, and the governor valves GV1–GV8. The logic task 1110 also controls the state of various lamps and relay type contact outputs in a predetermined manner. Another important part of the DEH system is the OPERATOR'S PANEL program. The operator communicates through the panel with the DEH control programs by means of various buttons which have assigned functions. When any button is pressed, a special interrupt is generated; this interrupt triggers a PANEL INTERRUPT program which decodes the button pressed, and then bids the PANEL task. The PANEL program processes the button and takes the proper action, which usually means manipulating some panel lamps, as well as passing on the button information to both the LOGIC and the CONTROL tasks.

The Operator's Panel also has two sets of display windows which allow display of all turbine program parameters, variables, and constants. A visual display task presents this information in the windows at the request of the operator through various dedicated display buttons and a numerical keyboard. The visual display values are periodically updated in the windows as the quantity changes.

Certain important turbine operating conditions are communicated to the DEH operator by way of flashing lamps on the panel. Therefore a special FLASH program is part of the DEH system. Its function is to monitor and detect such contingency conditions, and flash the appropriate lamp to alert the operator to the state.

1. PLANT CONTACT CLOSURE INPUT (PLANTCCI) SUBROUTINE

A plant contact closure input subroutine 1150 as shown in FIG. 6 scans all the contact inputs tied to the computer through the plant wiring 1126 and sets logic data images of these in designated areas within the memory 214 of the computer 210. Various situations call for the PLANTCCI subroutine. The most common case represents a basic design feature of the DEH system; that is, the situation in which a change of state of any contact input triggers a sequence of events interrupt. A corresponding interrupt program then calls the PLANTCCI subroutine to do a scan of all contact inputs and to update the computer contact image table. Thus (under normal conditions) a contact scan is carried out only when necessary. The plant contact closure input subroutine 1150 is also utilized when power to the computer 210 is turned on or when the computer buttons reset-run-reset are pressed on a maintenance panel 1410. Under these circumstances, a special monitor power-on routine 1412 is called upon. This program executes the computer STOP/INTIALIZE task described previously, which in turn calls the plant contact closure input subroutine for performance of the initializing procedure.

The operator can also call the plant contact closure input subroutine through the auxiliary synchronizer program, if desired, whereby a periodic scan of the entire computer CCI system is implemented for checking the state of any one or group of relays in the CCI system. This call is contingent upon the entry of a nonzero value for the constant PERCCI from the DEH Operator's Panel keyboard.

2. OPERATOR'S PANEL AND FLASH PROGRAM

Figure 7:
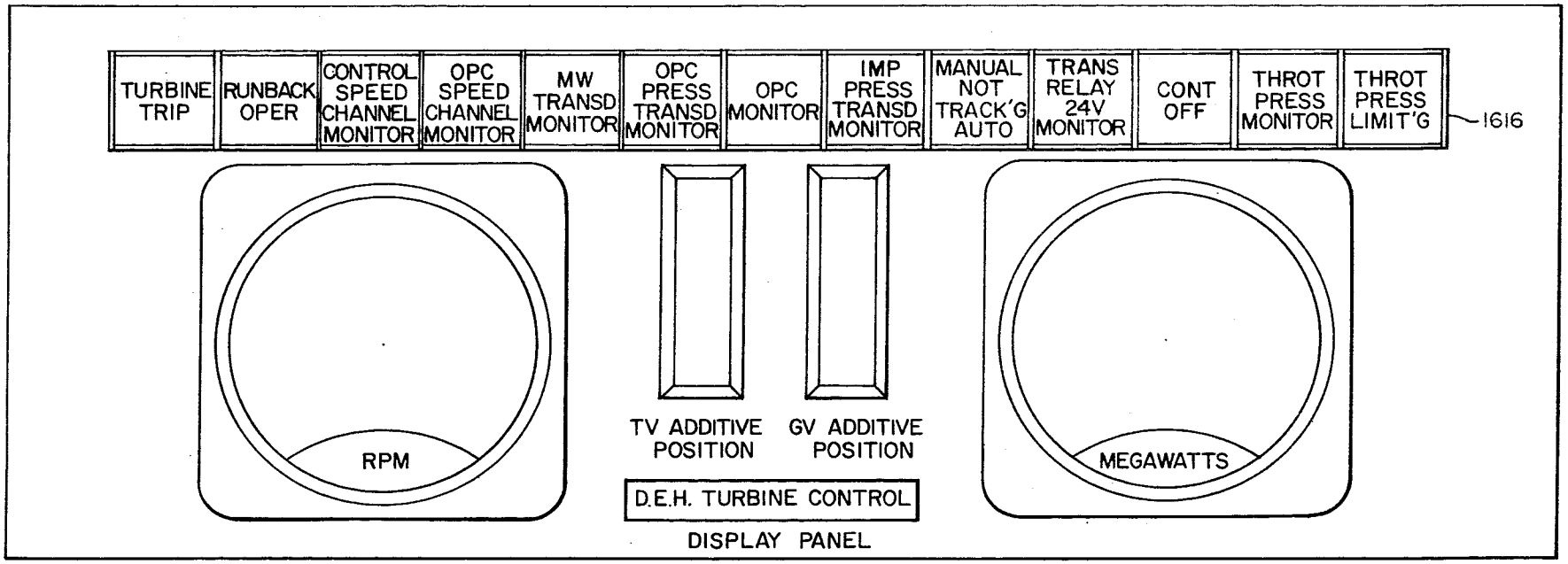
FIG. 7 shows a view of an part of an operator's control panel which is operable in accordance with the principles of the invention.
Figure 8:
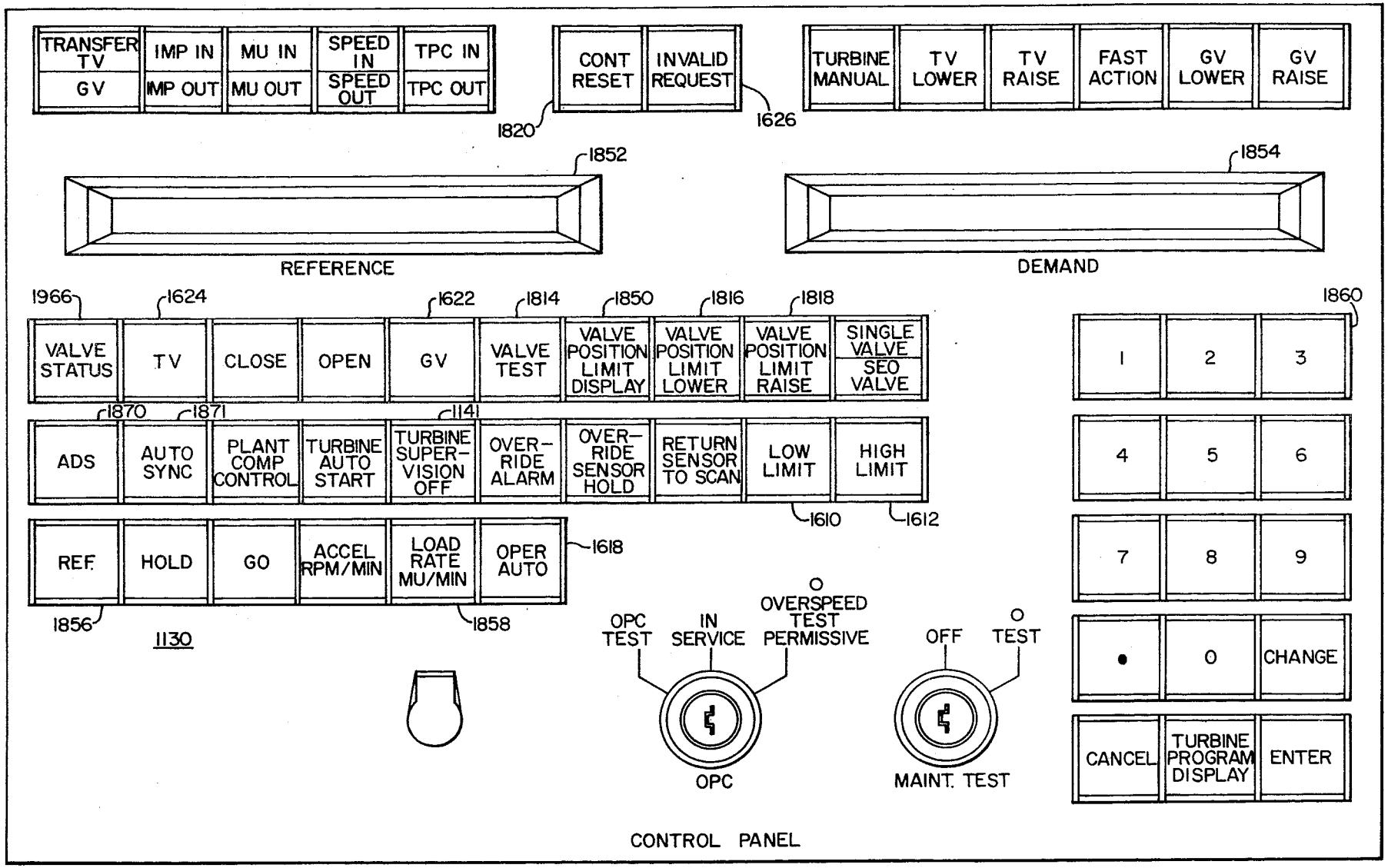
FIG. 8 shows a view of a part of the operators's control panel which is operable in accordance with the principles of the invention.
Figure 9:
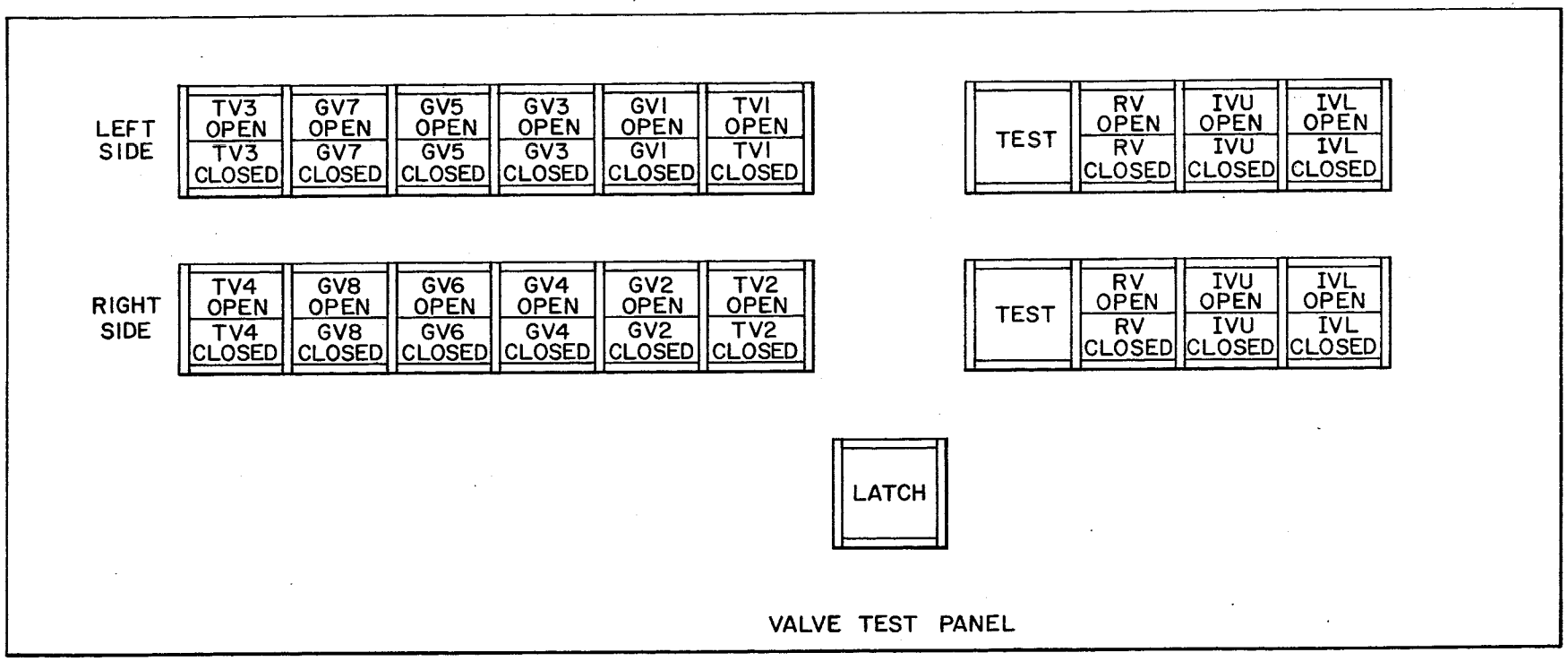
FIG. 9 shows a view of a portion of the operator's control panel which is operable in accordance with the principles of the invention.

Referring now to FIGS. 7, 8 and 9, the control panel 1130 for the digital electrohydraulic system 1100 is shown in detail. Specified functions have control panel buttons which flash in order to attract the attention of an operator. The FLASH task has two functions: it flashed appropriate lights to alert the operator to various important conditions in the DEH system, and it sets contact outputs to pass these same conditions to the Analog Backup and Boiler Control Systems. The FLASH task is on priority level 5 and is bid by the AUX SYNC task every ½ sec.

Figure 10:
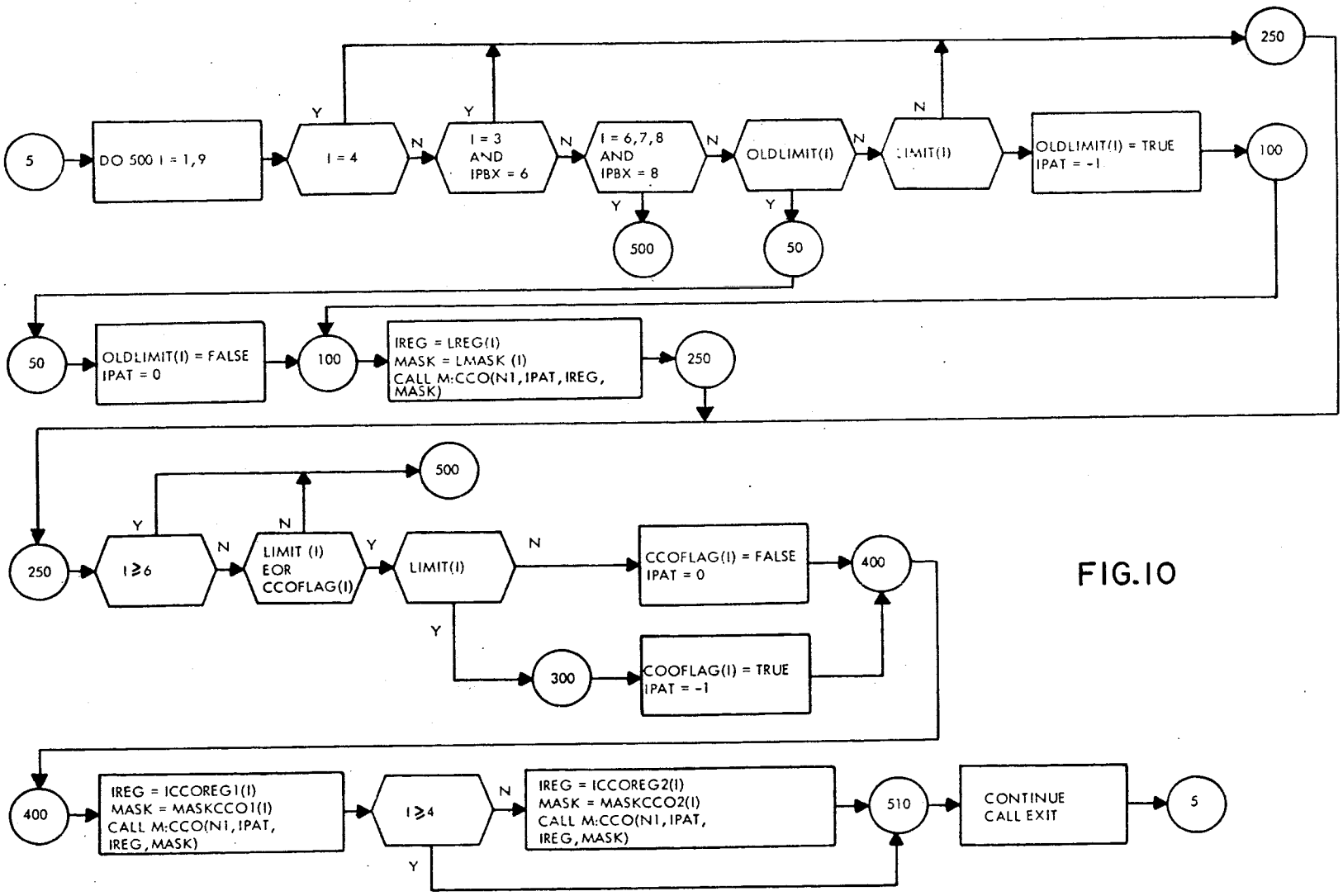
FIG. 10 shows a flow chart of a flash task which is operable in accordance with the principles of the invention.

FIG. 10 shows a detailed flow chart of the flash task 1136. The flash task is included in FIG. 6 as the flash task block 1136.

The concept behind the FLASH task is that flashing will attract the operator's attention much more quickly than simply maintaining a steady on condition. Most of the flashing lights indicate contingency conditions; a few indicate such things as invalid keyboard entries or that the DEH system is ready to go on automatic control. The flashing frequency is set at ½ sec on and ½ sec off as long as the condition exists. At the termination of the flashing condition, the corresponding lights and contacts are turned off.

A total of nine conditions are continually monitored for flashing by the FLASH task. These are listed below with a brief description of each.

1. Reference Low Limit — The turbine load reference is being limited by the low load limit.
2. Reference High Limit — The turbine load reference is being limited by the high load limit.
3. Valve Position Limit — The turbine governor valve output is being limited by the valve position limit.
4. Throttle Pressure Limit — The turbine load reference is being run back because throttle pressure is below set point. No light is flashed in this case but a contact output is set during the throttle pressure limiting.
5. DEH Ready for Automatic — The DEH control system has tracked the manual backup system and is ready to go on automatic control.
6. Valve Status Contingency — While on automatic control, the DEH system has detected a valve LVDT position not in agreement with its corresponding analog output.
7. Governer Valve Contingency — A governor valve LVDT position is not in agreement with its analog output.
8. Throttle Valve Contingency — A throttle valve LVDT position is not in agreement with its analog output.
9. Invalid Request — An invalid keyboard entry has been made.

In order to determine whether to flash a light or to suppress flashing, the FLASH task maintains two arrays in core memory. One of these is called LIMIT and contains the current value of the nine limiting or flashing conditions listed above, as they are set by various other DEH programs. The second array is called OLDLIMIT and is a image of the immediate past value of the LIMIT array. These two arrays are examined every ½ sec by the FLASH task according to the following table of combinations:

FLASH TASK LAMP COMBINATIONS

| LIMIT | OLDLIMIT | Action |
|---|---|---|
| 0 | 0 | Do Nothing |
| 0 | 1 | Turn Light Off |
| 1 | 0 | Turn Light On |
| 1 | 1 | Turn Light Off |

After the proper action is taken by the FLASH task, the OLDLIMIT array is then updated to agree with the current LIMIT array for the next pass through the task ½ sec later.

A third array called CCOFLAG is also maintained by the FLASH task in order to set contact outputs when a limiting condition exists. The contact outputs are not set and reset regularly (as are the flashing lights) but rather the contacts are set and remain on as long as the flashing condition exists. When the flashing condition ceases the contacts are reset. A table of combinations illustrating this action follows:

FLASH TASK CONTACT COMBINATIONS

| LIMIT | CCOFLAG | Action |
|---|---|---|
| 0 | 0 | Do Nothing |
| 0 | 1 | Reset Contact |
| 1 | 0 | Set Contact |
| 1 | 1 | Do Nothing |

It should be noted that only the first five flash conditions listed above have contact outputs associated with them; the remaining four simply flash Operator's Panel lights.

The control of the operation of the DEH control system 1100 is greatly facilitated for the operator by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time. Further, it is noteworthy that manual and automatic operator controls are at the same panel location for good operator interface under all operating conditions. More detail on the functioning of the panel pushbuttons is presented in Appendix 2 and elsewhere in the description of the DEH programs herein.

In addition the layout of the panel 1130 of FIGS. 7, 8 and 9 is unique and very efficient from operation and operator interface considerations. The control of the DEH system 110 by the buttons of the panel 1130 and the software programs thereto provides improved operation of the computer 210 and turbine generator 10.

Software details of the panel 1130 interface are available in the appendices 3, 4, 5 and 6.

3. PANEL INTERRUPT PROGRAM

The PANEL INTERRUPT program responds to Operator's Panel pushbutton requests by decoding the pushbutton identification and bidding the PANEL task to carry out the appropriate response. The PANEL INTERRUPT program is initiated by the Monitor interrupt handler.

The DEH turbine control system is designed to provide maximum flexibility to plant personnel in performing their function of operating the turbine. This flexibility is evidenced by an Operator's Panel with an array of pushbuttons arranged in functional groups, and an internal software organization which responds immediately to pushbuttom requests by the operator. The heart of this instant response is the interrupt capability of the DEH control system.

Pressing any panel pushbutton activates a diode-decoding network which identifies the pushbutton, sets a group of six contacts to an appropriate coded pattern, and generates an interrupt to the computer. The Monitor interrupt handler responds within microseconds and runs the PANEL INTERRUPT program, which does a demand contact input scan of the special panel pushbutton contacts and bids the PANEL task to carry out the function requested by the operator.

4. VALVE TEST, VALVE POSITION LIMIT

Certain valve testing and limiting functions have been a traditional turbine control feature over the years to provide assurance of the emergency performance of valves and to give the operator a final override on the control valve position. Thus, on line testing of throttle valves periodically will detect potential malfunctions of the throttle valve mechanism which could be dangerous if not corrected. In addition, valve position limiting of the governor valves during on line operation provides a manual means of limiting steam flow from the Operator's Panel.

In the DEH control system these two important functions are initiated by appropriate pushbuttons on the panel. As long as the operator presses one of these pushbuttons, the proper action is carried out by the CONTROL program. When the operator releases any of these pushbuttons, this generates a special interrupt to terminate the action which has been performed.

Referring again to FIG. 6, a valve test program 1810 and a valve position limit program 1812 are subroutines of the control task program 1020. The valve test program 1810 tests the operation of any predetermined valve or valves such as the throttle valves TV1 through TV4 by the operator pressing a valve test button 1814 of FIG. 18 on the operator's panel 1130. The valve position limit program 1812 of the control task 1020 operates when an operator presses either of the two buttons, valve position limit lower 1816 or valve position limit raise 1818 of FIG. 8.

Referring again to FIG. 8, upon the release of the valve test button 1814, the valve position limit lower button 1816 or the valve position limit raise button 1818 by an operator, the valve interrupt program 1158 shown in FIG. 6, is run by the monitor program 1122. The monitor program 1122 runs the valve interrupt program 1158 and thereby resets various flags and counters thus signaling to the control task 1020 that the action is to cease.

5. VISUAL DISPLAY PROGRAM

Visual display of numerical information which resides in memory has been a traditional function of control computer systems. This feature provides communication between the operator and the controller, with both display and changing of internal information usually available. Continuous display of a quantity provides visual indication of trends, patterns and dynamic response of control system variables; periodically updated values of the displayed quantity are entered into the windows so that fast changes may readily be obversed by operating and technical personnel.

The DEH control system has provision for visual display of six important control quantities through dedicated individual pushbuttons. In addition, complete valve status (i.e. position) may be displayed through a group of appropriate pushbuttons; all remaining control system variables, parameters or constants may be displayed through another pushbutton, in conjunction with keyboard-entered dictionary addresses which select the desired quantity for display.

Figure 12:
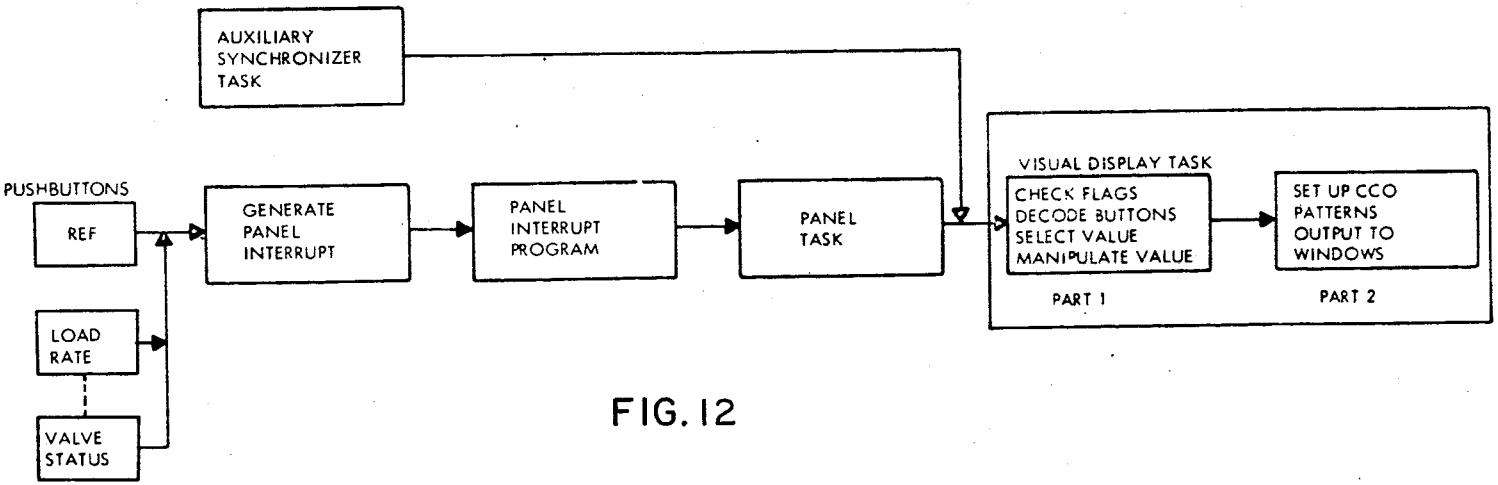
FIG. 12 is a block diagram of a visual display system which is operable in accordance with the principles of the invention.
Figure 13:
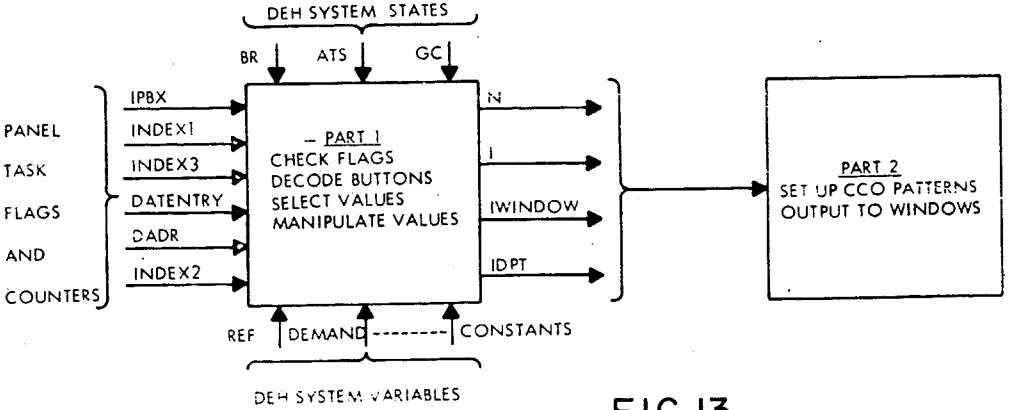
FIG. 13 is a block diagram of the execution of a two-part visual display function which is operable in accordance with the principles of the invention.
Figure 14:
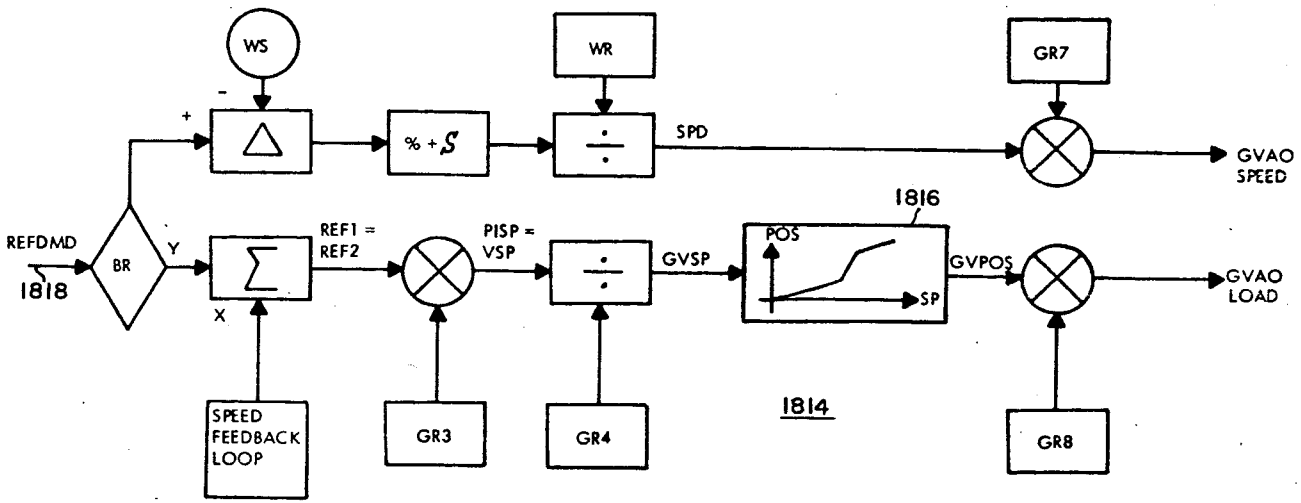
FIG. 14 is a block diagram of a load control system which is operable in accordance with the principles of the invention.

The visual display program 1134 as shown in FIG. 6 is connected with the panel interrupt program 1156 and the auxiliary synchronizer program 1114. The visual display program 1134 controls the display windows 1138 with a reference window 1852 and a demand window 1854. The demand window 1854 and the reference window 1852 are also shown in FIG. 8 as part of the operator's panel 1130. By pressing an appropriate button such as the reference button 1856 a reference value will be displayed in the reference window 1852 and a demand value will be displayed in the demand window 1854. Similarly, for example, if a valve position limit display button 1858 is pressed a valve position limit value will be displayed in the reference window 1852 and the corresponding valve variable being limited is displayed in the demand window 1854. Upon pressing the load rate button 1858 the load rate will be displayed in the reference window 1852. In addition, a keyboard 1860 has the capability through an appropriate program to select virtually any parameter or constant in the DEH system 1100 and display that parameter in the reference window 1852 and the demand window 1854. Referring now to FIG. 11 a table of the display buttons and their functions is given in greater detail. In FIG. 12 a block diagram of the visual display program system is shown. FIG. 33 shows a block diagram of the execution of a two-part visual display function.

6. ANALOG SCAN PROGRAM

In order to carry out its function, a computer control system must be provided with input signals from the process or plant variables which are to be controlled. However, the vast majority of real process variables (for example pressure, temperature and position) are analog or continuous in their natural form, whereas the organization and internal structure of computers is digital or discontinuous in nature. This basic difference in information format between the controller and the controlled process must be overcome with interfacing equipment which converts process signals to an appropriate computer numerical value.

A device which can accomplish this function is the analog-to-digital (A/D) converter. The A/D converter provides the interface between plant analog instrumentation and the digital control system. Normally the analog signal as picked up from a transducer is in the millivolt or volt range, and the A/D converter produces an output bit pattern which may be stored in computer memory. A/D converters can only convert a limited number of analog inputs to digital form in a given interval of time. The usual method of stating this limit is to indicate the number of points (analog inputs) which can be converted in 1 sec. Thus, the A/D converter used in the DEH system has a capacity of 40 pps. Since the total number of analog inputs to the DEH system may be as high as 224, depending on the type of turbine to be controlled and the control system options selected, most of these must be scanned at a reduced frequency.

The nature of the plant variables which represent the analog inputs, and the sampling frequency of control programs using these inputs, are normally considered when one determines the scanning frequency of various analog input signals. In the DEH system, the control programs execute once a second and the primary analog signals used by the control system are generated megawatts, impulse pressure, throttle pressure, turbine speed and valve position. Since each of these variables may change a significant amount in a few seconds, all of these are scanned once a second. On the other hand, the majority of the analog inputs to the ATS program are temperatures which require minutes before significant changes in them may be observed. Consequently, all temperatures in the DEH system are scanned once a minute. The ATS program also requires a group of vibrations, which are scanned once every 5 sec, and a group of miscellaneous variables which are scanned once every 10 sec.

The analog scan program 1116, shown in FIG. 6 periodically scans all analog inputs to the DEH system 1100 for control and monitoring purposes. The function of the analog scan program is performed in two parts. The first part of the analog scan program 1116 comprises the scanning of a first group of analog inputs. Values of scanned inputs are converted to engineering units and the values are checked against predetermined limits as required for computations in the DEH computer.

The second part of the function of the analog scan program 1116 comprises the scanning of the analog inputs required for the automatic turbine startup program as shown in FIG. 6. Conversion and limit-checking of this latter group of inputs is performed by another program. The automatic turbine startup program is shown in FIG. 6 as the ATS periodic program 1140, the ATS analog conversion routine 1142 and the ATS message writer program 1144.

7. LOGIC TASK

The LOGIC task determines the operational status of the DEH turbine control system from information provided by the plant, the operator, and other DEH programs.

A contact input from the plant wiring triggers the sequence of events or interrupt program which calls upon the plant contact closure input subroutine which in turn requests that the logic program 1110 be executed by the setting of a flag called RUNLOGIC.

The logic program 1110 is also run by the panel interrupt program 1156 which calls upon the panel task 1112 to run the logic program 1110 in response to panel button operations. The control task 1020 in performing its various computations and decisions will sometimes request the logic program 1110 to run in order to update conditions in the control system.

The mechanism for actual execution of the LOGIC program is provided by the AUX SYNC task, which runs every 1/10 sec and carries out the scheduled and demand bidding of various tasks in the DEH system. AUX SYNC checks the state of the RUNLOGIC flag and, if it is set, bids the LOGIC task immediately. Thus, the maximum response time for LOGIC requests is 1/10 sec; on the average the response will be much faster than this.

In order to allow immediate rerunning of the LOGIC task should system conditions require, the LOGIC program first resets RUNLOGIC. Thus any other program may then set RUNLOGIC and request a bid which will be carried out by the AUX SYNC program within 1/10 sec. There are two major results of the LOGIC task: the computation of all logic states necessary for proper operation of the DEH system, and the processing of all status and monitor lamp contact outputs to inform the plant control system and operating personnel of the state of the DEH system.

The logic program 1110 controls a series of tests which determine the readiness and operability of the DEH system 1100. One of these tests is that for the overspeed protection controller which is part of the analog backup portion of the hardwired system 1016 shown in FIG. 4. Generally, the logic program 1110 is structured from a plurality of subroutines which provide the varying logic functions for other programs in the DEH program system, and the various logic subroutines are all sequentially executed each time the logic program is run.

LOGIC CONTACT CLOSURE OUTPUT SUBROUTINE

The logic task 1110 includes a subroutine called a logic contact closure output subroutine therein. The logic contact closure output subroutine updates all the digital outputs to the status lamps and contacts for transmission thereto. The logic program 1110 handles a great number of contact outputs thereby keeping the output logic states of the DEH computer current. In addition, certain logical variables, which are normally set by the PANEL task, must be aligned by the LOGIC task with conditions as they exist instant by instant in the power plant. To do these functions in-line for each output in the LOGIC task would take considerable core storage to accommodate the individual situations. Thus, the logic contact closure output subroutine 1910 reduces the total storage requirements otherwise required for the logic program 1110.

MAINTENANCE TEST

In order to take advantage of the full flexibility, adjustability and dynamic response of the DEH system 1100 a maintenance test system 1810 is provided. The maintenance test program 1810 allows an operator to change, adjust or tune a large number of operational parameters and constants of the DEH system 1100. The constants of the DEH system 1100 can therefore be modified without extensive ajustment or reprogramming. An operator is able to optimize the DEH system 1100 from the control panel 1130 as shown in FIGS. 7 and 8 which allows for an essentially infinite variability in the choice of constants. Great flexibility and control is therefore available to an operator.

In addition, the maintenance test program allows an operator to use a simulation mode for operator training purposes.

AUTOMATIC TURBINE STARTUP (ATS) LOGIC

Modern methods of starting up turbines and accelerating to synchronous speed require careful monitoring of all turbine metal temperatures and vibrations to assure that safe conditions exist for continued acceleration. Until recently, these conditions have been observed by plant operators visually on various panel instruments. However, all of the important variables are rarely available from the plant instrumentation, and even if they were, the operator can not always be depended upon to make the right decision at a critical time. In addition to these factors, it is impossible to instrument the internal rotor metal temperatures, which are extremely important for indicating potentially excessive mechanical stress.

To improve the performance at startup, automatic turbine accelerating programs have been written and placed under computer control. Such programs monitor large numbers of analog input signals representing all conceivable turbine variables, and from this information the program makes decisions on how and when to accelerate the unit. In addition, these programs numerically solve the complex heat distribution equations which describe temperature variations in the critical rotor metal parts. From these termal computations it is possible to predict mechanical stresses and strains, and then to automatically take the proper action in the acceleration of the turbine.

The DEH system has such an automatic turbine startup program available as an optional item. Besides supervising the acceleration as described above, the program provides various messages printed on a typewriter to keep the operator informed as to the turbine acceleration progrprogress. In addition, a group of monitor lamps are operated to indicate key points in the startup stages and to indicate alarm or contingency conditions. The automatic turbine startup logic program detects those conditions concerned with this DEH feature and sets all logical states accordingly.

8. PANEL TASK

The DEH Operator's Panel is the focal point of turbine operation; it has been designed to make use of the latest digital techniques to provide maximum operational capability. The Operator's Panel provides the primary method of communicating information and control action between the operator and the DEH Control System. This is accomplished through a group of pushbuttons and a keyboard (which together initiate a number of diverse actions), and two digital displays (which provide the operator with visual indication of internal DEH system numerical values).

When pressed, any of the buttons on the Operator's Panel provide momentary action during which a noramlly-open contact is connected to an electronic diode matrix. Operation of a button energizes a common computer interrupt for the Operator's Panel and applies voltage to a unique combination of 6 contact inputs assigned as a pushbutton decoder. The diode matrix may be used to identify up to 60 pushbuttons. When a button is pressed, the associated interrupt is read within 64 $\mu$ sec, and the corresponding contact inputs scanned and stored in computer memory as a bit pattern for further processing.

Each of the buttons on the panel are backlighted. When a button is pressed and appropriate logical conditions exist, the lamp is turned on to acknowledge to the operator that the action he initated has been carried out. Should the proper logical conditions not be set, the lamp is not turned on. This informs the operator that the action he requested cannot be carried out.

A few of the buttons are of the digital push-push type which when pushed once initiate an action, and when pushed again suppress that action. Some of these buttons also contain a split lens which indicates one action in the upper half of the lamp and another (usually opposite) action in the lower lens. In addition, certain button backlights are flashed under particular operating circumstances and conditions.

The buttons and keys on the Operator's Panel may be grouped in broad functional groups according to the type of action associated with each set of buttons. A brief description of these groups follows:

1. CONTROL SYSTEM SWITCHING

These buttons alter the configuration of the DEH Control System by switching in or out certain control functions. Examples are throttle pressure control and impulse pressure control.

DISPLAY/CHANGE DEH SYSTEM PARAMETERS

These buttons allow the operator to visually display and change important parameters which affect the operation of the DEH system. Examples are the speed and load demand, high and low load limits, speed and load rate settings, and control system tuning parameters.

3. OPERATING MODE SELECTION

This group of buttons provides the operator with the ability to select the turbine operating mode. Examples are permitting an Automatic Synchronizer or an Automatic Dispatch System to set the turbine reference, or selecting local operator automatic control of the turbine (which includes hold/go action).

4. VALVE STATUS/TESTING/LIMITING

This group of buttons allows valve status information display, throttle/governor valve testing, and valve position limit adjustment.

5. AUTOMATIC TURBINE STARTUP

This group of buttons is used in conjunction with a special DEH program which continuously monitors important turbine variables, and which also may start up and accelerate the turbine during wide-range speed control.

6. MANUAL OPERATION

These buttons allow the operator to manually control the position of the turbine valves from the Operator's Panel. The DEH PANEL task has no direct connection with this group of buttons.

7. KEYBOARD ACTIVITY

These buttons and keys allow numerical data to be input to the DEH system. Such information may include requests for numerical values via the display windows, or may adjust system parameters for optimum performance.

Figure 15:
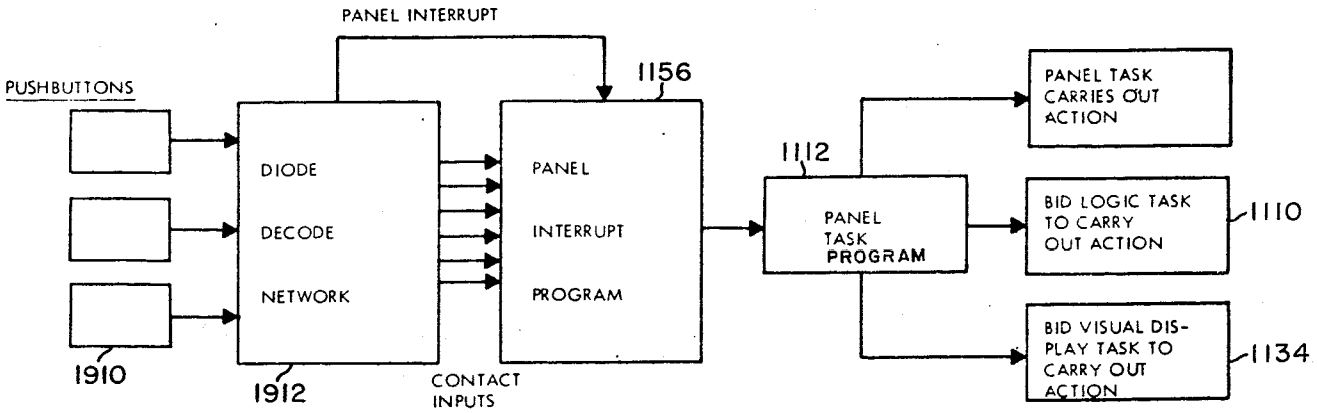
FIG. 15 is a block diagram showing a panel task interaction function which is operable in accordance with the principles of the invention.

The panel task 1112 responds to the buttons pressed on the operator's panel 1130 by an operator of the DEH control system 1100. The control panel 1130 is shown in FIGS. 7 and 8. Referring now to FIG. 15, the interactions of the panel task 1112 are shown in greater detail. Pushbuttons 1110 are decoded in a diode decoding network 1912 which generates contact inputs to activate the panel interrupt program 1156. The panel interrput program scans the contact inputs and bids the panel task 1112 whereby the pressed button is decoded and either the panel task 1112 carries out the desired action or the logic task 1110 is bid or the visual display task 1134 is called to carry out the desired command. pg,58 8. PANEL TASK The panel task 1112 responds to the buttons pressed on the operator's panel 1130 by an operator of the DEH control system 1100. The control panel 1130 is shown in FIGS. 7 and 8. Referring now to FIG. 15, the interactions of the panel task 1112 are shown in greater detail. Pushbuttons 1110 are decoded in a diode decoding network 1912 which generates contact inputs to activate the panel interrupt program 1156. The panel interrupt program scans the contact inputs and bids the panel task 1112 whereby the pressed button is decoded and either the panel task 1112 carries out the desired action or the logic task 1110 is bid or the visual display task 1134 is called to carry out the desired command.

9. CONTROL PROGRAM

Automatic control of turbine speed and load requires a complex, interacting feedback control system capable of compensating for dynamic conditions in the power system, the boiler and the turbine-generator. Impulse chamber pressure and shaft speed from the turbine, megawatts from the generator, and throttle pressure from the boiler are used in the controlled operation of the turbine.

In addition to the primary control features discussed above, the DEH system also contains provisions of high and low load limits, valve position limit, and throttle pressure limit; each of these can be adjusted from the Operator's Panel. A number of auxiliary functions are also available which improve the overall turbine performance and the capabilities of the DEH system. Brief descriptions of these follow:

1. Valve position limit adjustment from the Operator's Panel.
2. Valve testing from the Operator's Panel.
3. Speed signal selection from alternate independent sources.
4. Automatic instantaneous, and bumpless operating-mode selection from the Operator's Panel.
5. A continuous valve position monitor and contingency-alert function for the operator during automatic control.
6. A digital simulation and training feature which allows use of the Operator's Panel and most of the DEH system at any time on manual control, without affecting the turbine output or valve position. This powerful aid is used for operator and engineer training, simulation studies, control system tuning or adjustment, and for demonstration purposes. In order to achieve these objectives, the CONTROL task is provided with analog inputs representing the various important quantities to be controlled, and also is supplied with contact inputs and system logical states.

Figure 17:
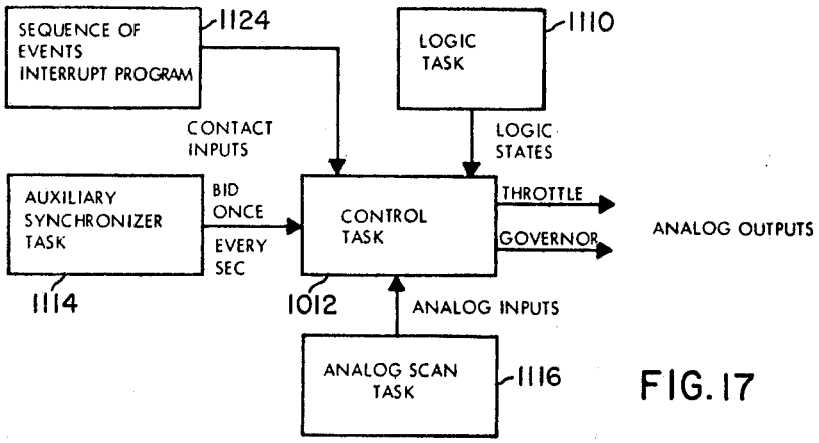
FIG. 17 is a block diagram showing a control task interface which is operable in accordance with the principles of the invention.
Figure 18:
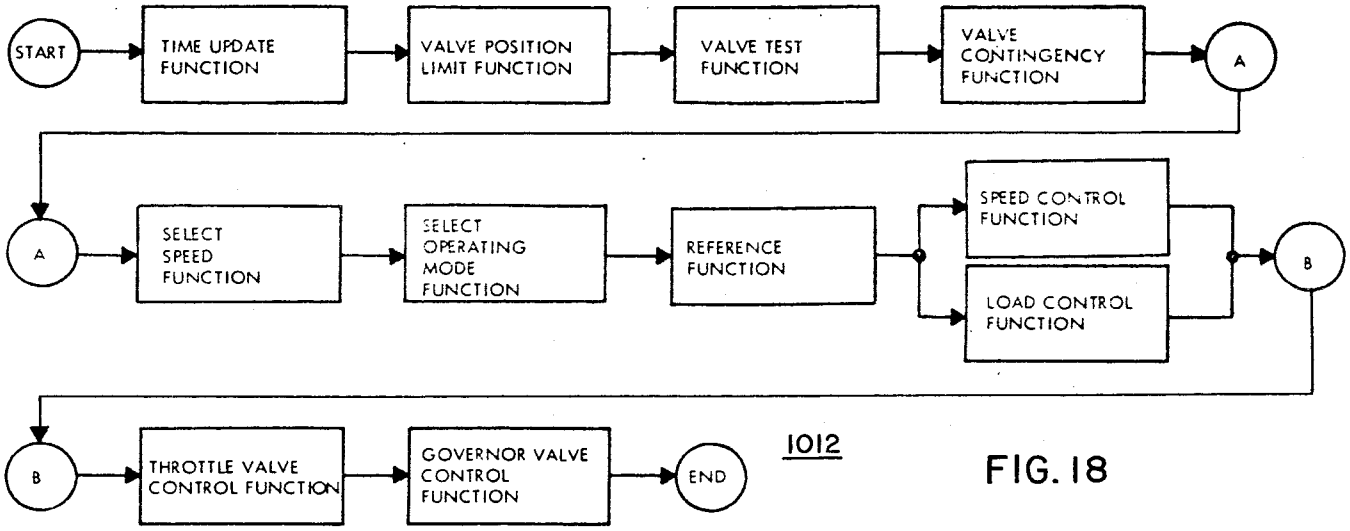
FIG. 18 is a block diagram showing a control program which is operable in accordance with the principles of the invention.

The control program 1012 and related programs are shown in greater detail in FIG. 17. In the computer program system, the control program 1012 is interconnected with the analog scan program 1116, the auxiliary sync program 1114, the sequence of events interrupt program 1124 and the logic task 1110. FIG. 18 shows a block diagram of the control program 1012. The control program 1012 accepts data from the analog scan program 1116, the sequence of events interrupt program 1124 and is controlled in certain respects by the logic program 1110 and the auxiliary synchronizing program 1114. The control program 1012, upon receiving appropriate inputs, computes the throttle valve TV1–TV4 and the governor valve GV1–GV8 outputs needed to satisfy speed or load demand.

The control program 1012 of the DEH control system 1100 functions, in the preferred embodiment, under three modes of DEH system control. The modes are manual, where the valves GV1–GV8 and TV1–TV4 are positioned manually through the hardwired control system and the DEH control computer tracks in preparation for an automatic mode of control. The second mode of control is the operator automatic mode, where the valves GV1–GV8 and TV1–TV4 are positioned automatically by the DEH computer in response to a demand signal entered from the keyboard 1130, of FIG. 8. The third mode of control is remote automatic mode, where the valves GV1–GV8 and TV1–TV4 are positioned automatically as in the operator automatic mode but use the automatic turbine startup program 1141 or an automatic synchronizer or an automatic dispatch system for setting the demand value.

VALVE POSITION LIMIT FUNCTION SUBROUTINE

Figure 19:
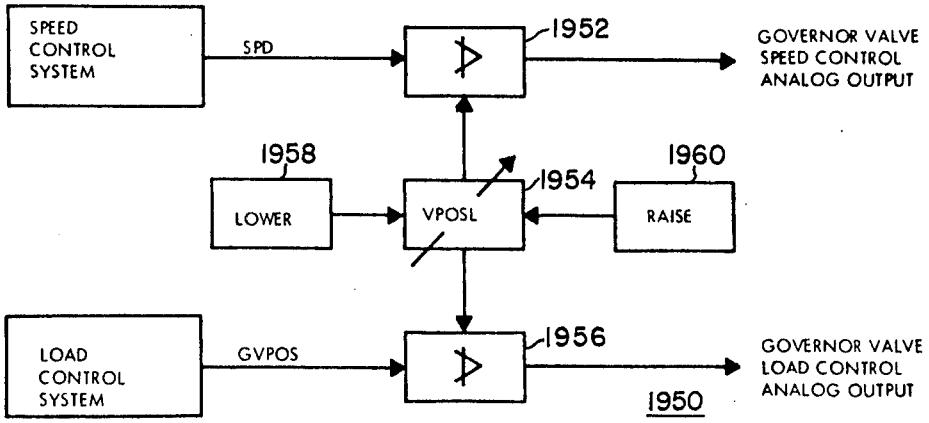
FIG. 19 is a block diagram showing a valve postion limit function which is operable in accordance with the principles of the invention.

Referring now to FIG 19, a block diagram of the valve position limit function subroutine 1950 is shown in detail. A speed control signal is limited by limit function 1952 which is controlled by the valve position limit function 1954 (VPOSL); similarly the governor valve speed signal (GVPOS) signal is limited by limiting function 1956. The valve position limit function 1954 may be raised by a raise function 1960 and lowered by a lower function 1958.

VALVE CONTINGENCY FUNCTION

Figure 20:
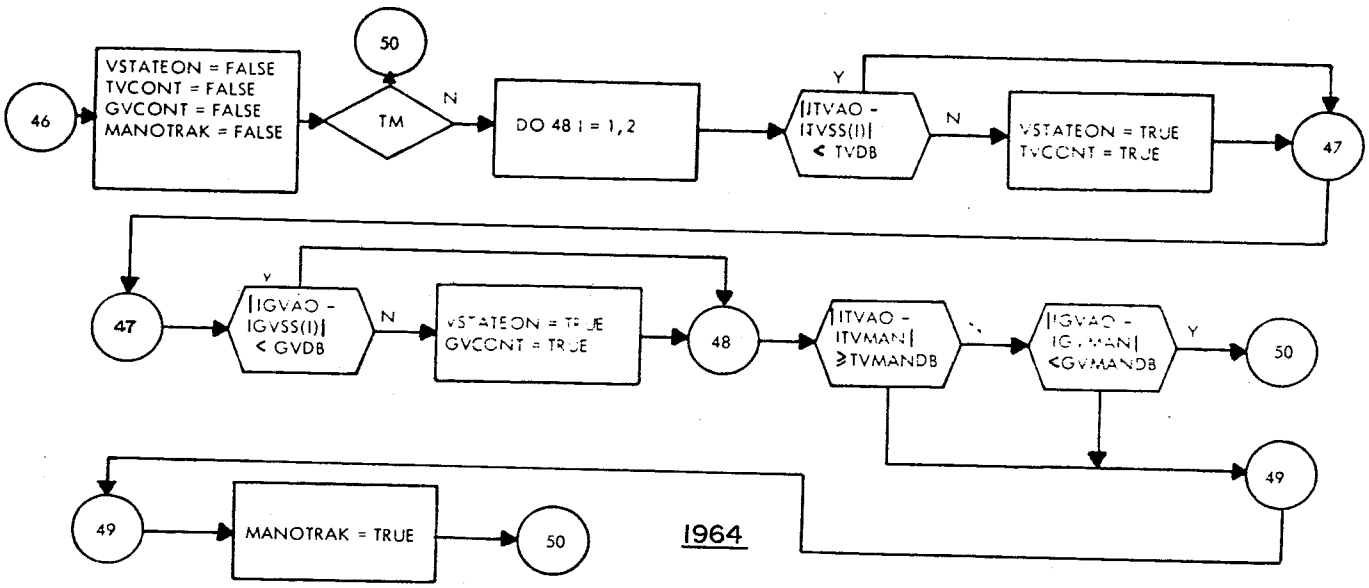
FIG. 20 is a flow chart showing a valve contingency program which is operable in accordance with the principles of the invention.
Figure 21:
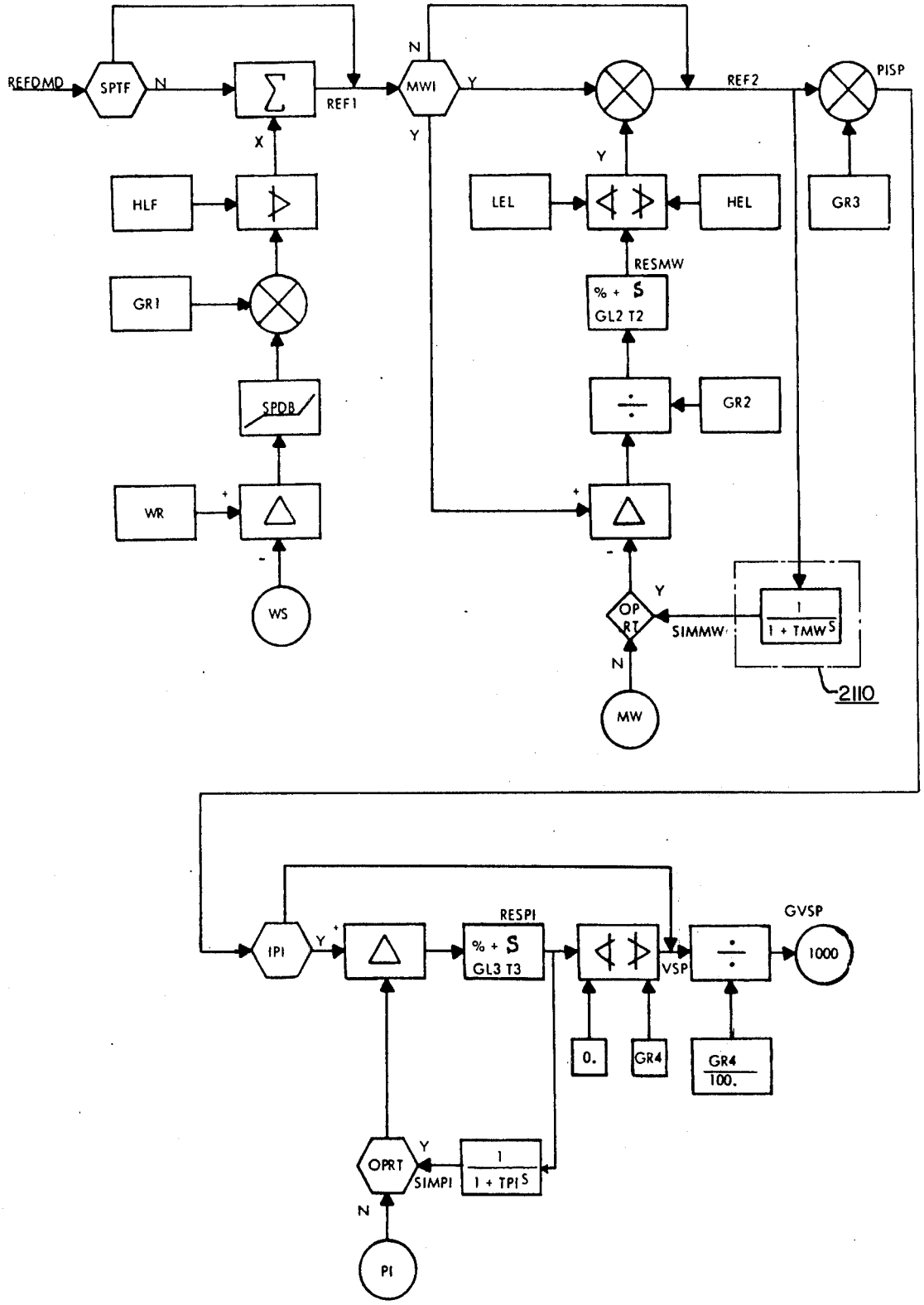
FIG. 21 shows a block diagram of the load control system which is operable in accordance with the principles of the invention.
Figure 22:
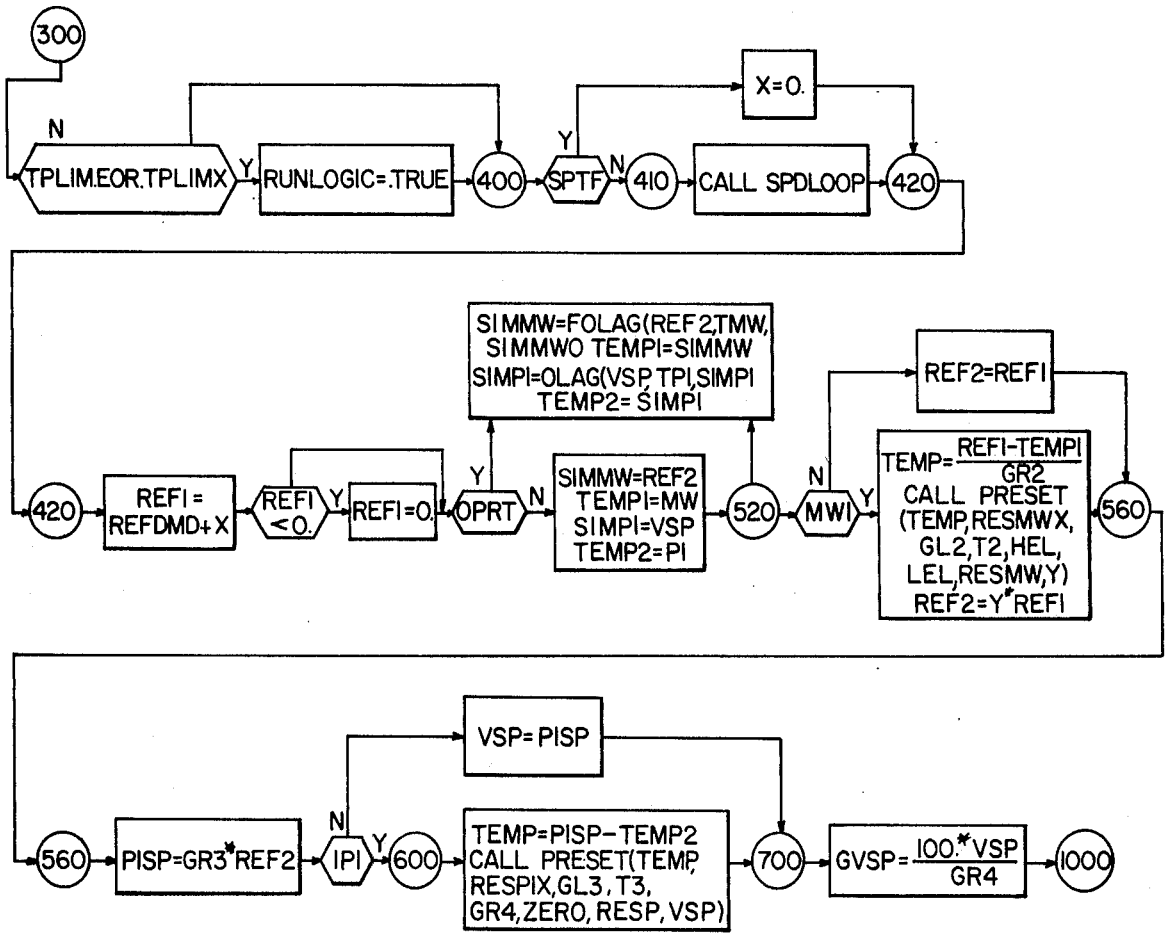
FIG. 22 includes a flow chart of the load control system which is operable in accordance with the principles of the invention.
Figure 23:
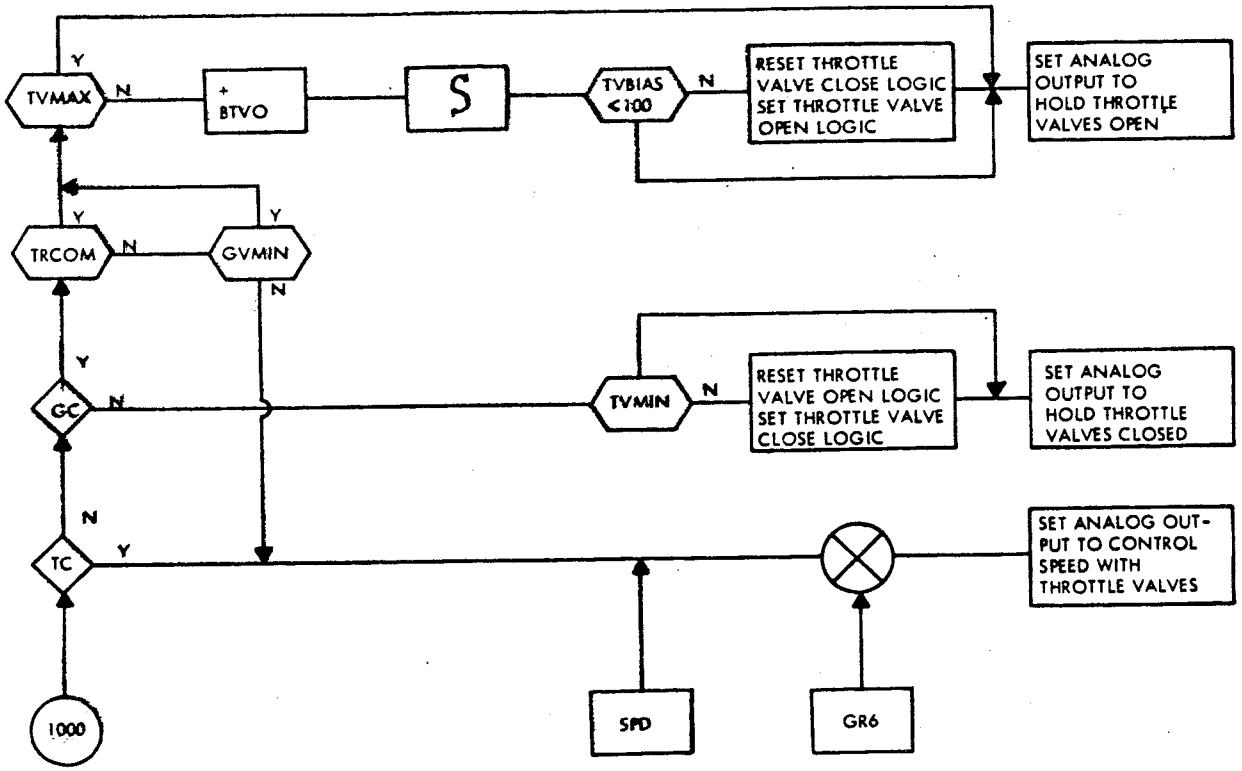
FIG. 23 shows a block diagram of the throttle valve control function is operable in accordance with the principles of the invention.
Figure 24:
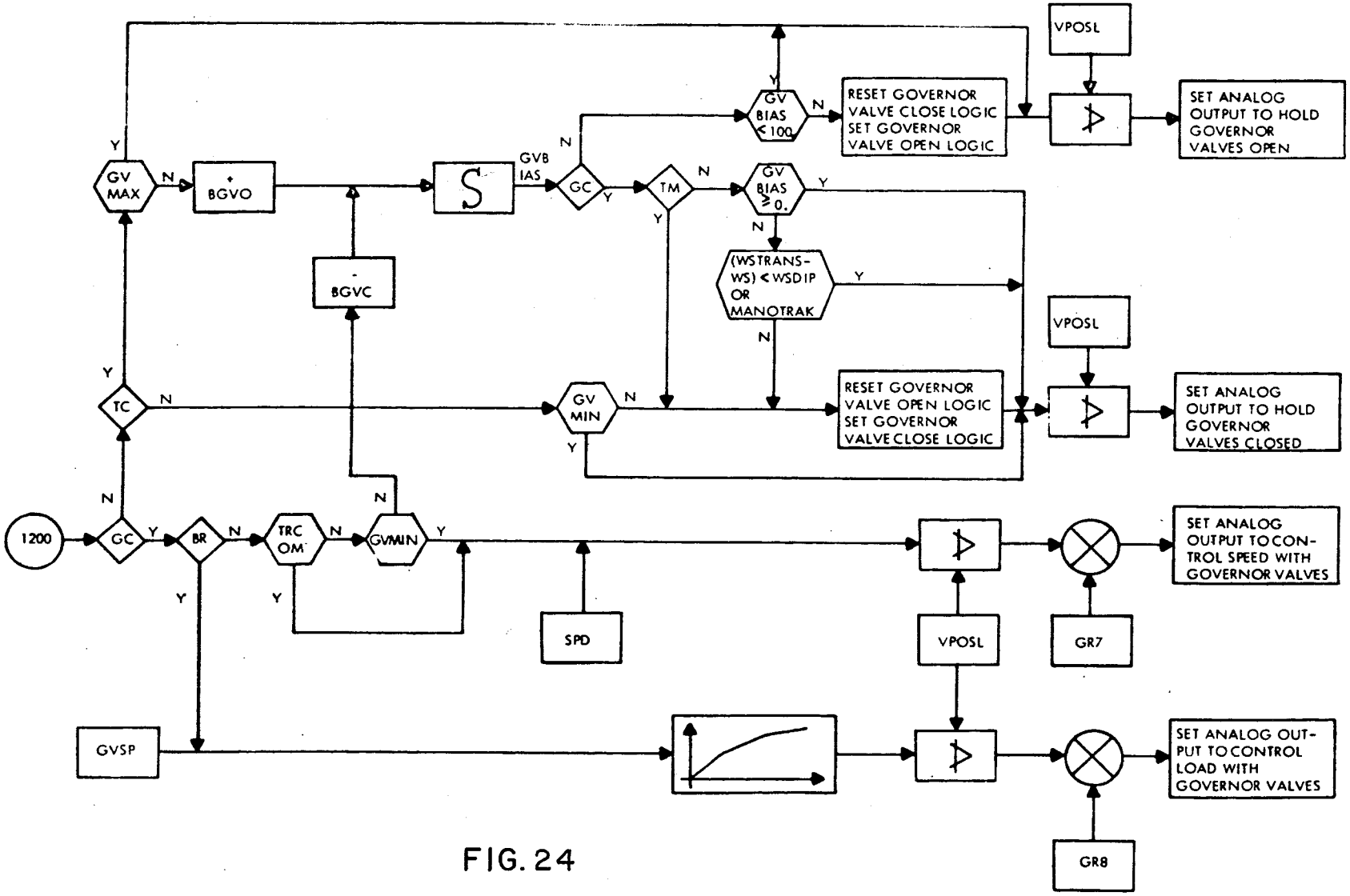
FIG. 24 shows a mixed block diagram of a governor control function program which is operable in accordance with the principles of the invention.
Figure 25:
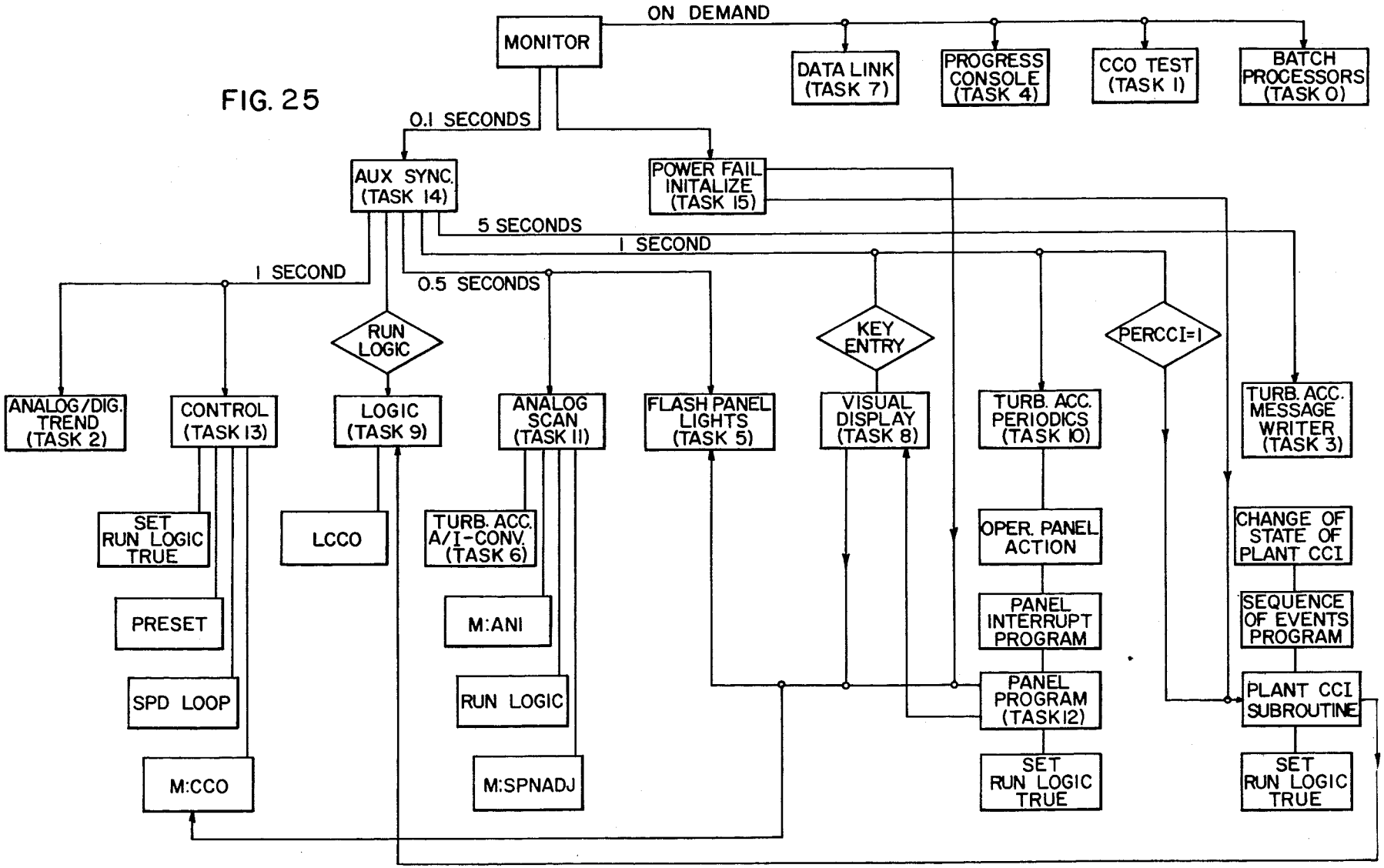
FIG. 25 shows a block diagram of the Digital Electro Hydraulic System which is operable in accordance with the principles of the invention.

A valve contingency function 1964 is shown in the flow chart of FIG. 20. In the automatic control mode, the valve contingency function subroutine 1964 continuously checks for discrepancies between the positions of the governor valves GV1 to GV8 called for by the DEH controller system 1100 and the actual valve positions sensed by a linear variable differential transformer LVDT. If the decrepancy between the sensed and actual positions exceeds a predetermined value set on the keyboard 1860 of the operator's panel 1130, shown in FIG. 8, a valve status lamp 1966 warns the operator of this discrepancy situation. system 1100 and the actual valve positions sensed by a linear variable differential transformer LVDT. If the decrepancy between the sensed and actual positions exceeds a predetermined value set on the keyboard 1860 of the operator's panel 1130, shown in FIG. 8, a valve status lamp 1966 warns the operator of this discrepancy situation. The valve contingency subroutine 1964 interfaces with the process and the operator through the analog scan program 1116 and the operator's panel 1130 of FIG. 6.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode -- pulse type contact input for adjusting the turbine speed reference and speed demand and moving the turbine 10 to synchronizing speed and phase.
2. Automatic turbine startup program mode -- provides a turbine speed demand and rate.
3. Operator automatic mode -- speed, demand and rate of change of speed entered from the keyboard 1860 on the operator's panel 1130 shown in FIG. 8.
4. Maintenance test mode -- speed demand and rate of change of speed are entered by an operator from the keyboard 1860 on the operator's control panel 1130 of FIG. 8 while the DEH system 1100 is being used as a simulator or trainer.
5. Manual tracking mode -- the speed demand and rate of change of speed are internally computed by the DEH system 1100 and set to track the manual analog back-up system 1016 as shown in FIG. 4 in preparation for a bumpless transfer to the operator automatic mode of control.

With the breaker 17 closed and the turbine 10 in the level mode control, the following modes of operation may be selected:

1. Throttle pressure limiting mode -- a contingent mode in which the turbine load reference is run back or decreased at a predetermined rate to a predetermined minimum value as long as predetermined condition exists.
2. Run-back mode -- a contingency mode in which the load reference is run back or decreased at a predetermined rate as long as a predetermined condition exists.
3. Automatic dispatch system mode -- pulse type contact inputs are supplied from an automatic dispatch system to adjust turbine load reference and demand when the automatic dispatch system button 1870 on the opertor's panel 1130 is depressed.
4. Operator automatic mode -- the load demand and the load rate are entered from the keyboard 1830 on the control panel 1130 in FIG. 8.
5. Maintenance test mode -- load demand and load rate are entered from the keyboard 1860 of the control panel 1130 in FIG. 8 while the DEH system 1100 is being used as a simulator or trainer.
6. Manual tracking mode -- the load demand and rate are internally computed by the DEH system 1100 and set to track the manual analog back-up system 1016 preparatory to a bumpless transfer to the operator automatic mode of control.

The select operating mode function responds immediately to turbine demand and rate inputs from the appropriate source as described above. This program determines which operating mode is currently in control by performing various logical and numerical decisions, and then retrieves from selected storage locations the correct values for demand and rate. These are then passed on to the succeeding DEH control programs for further processing and ultimate positioning of the valves. The select operating mode function also accommodates switching between operating modes, accepting new inputs and adapting the DEH system to the new state in a bumpless transfer of control.

Various contact inputs are required for raise and lower pulses, manual operation, maintenance test, and so forth; these are handled by the SEQUENCE OF EVENTS interrupt program and the PLANTCCI subroutine, which performs a contact input scan. In addition, certain panel pushbuttons affect the operating mode selection; these are handled by the PANEL INTERRUPT program and the PANEL task, which decode and classify the pushbuttons pressed. The LOGIC task then checks all permissive conditions and current control system status, and computes the appropriate logical states for interpretation by the CONTROL task and the SELECT OPERATING MODE program.

E. SUMMARY

Improved turbine and plant operation and management results from the disclosed turbine monitoring and operator interface systems and methods. The improvements stem from advances in functional performances, operating efficiency, operating economy, manufacturing design and operating flexibility and operating convenience. Panel monitoring, information transmission and warning systems greatly increase the usefulness, ease-of-operation and inherent reliability of the present system.

The present system has an elaborate programming system for better communications between an operator and the digital computer through use of special panel task program. The panel programs include a buttondecoding program, a control switching system, a display system for displaying a vast number of system parameters of the turbine generator system, a system for changing during operation most parameters and constants in the digital computer with great ease and rapidity, a capability to select a great number of operating modes, a system for checking the status of predetermined valves in the system and display devices therefor, a testing system for predetermined valves in the system, a limiting provision for limiting the position of predetermined valves in the system. In addition the panel programs provide for the control of automatic turbine startup programs; the control of the digital computing system through the use of a series of manual buttons, switches, toggles, etc.; the program capability of monitoring keyboard activity for failsafe and improper operation thereby preventing operator mistakes from resulting in improper signals and signaling means for warning an operator of any improper commands or mistakes in his operation of the keyboard, panels etc.

VISUAL DISPLAY TASK

The VISUAL DISPLAY task is on priority level 8 and is normally bid by the AUX SYNC task every 1 sec; however, when the operator requests a new display quantity, then VISUAL DISPLAY will be bid initially by the PANEL task.

A description of the display pushbuttons is given in FIG. 11, where there is also included the value of the counter (IPBX) which identifies these buttons to the appropriate DEH programs. Since most of the display pushbuttons in FIG. 11 are dedicated to a single quantity, the programming mechanism to accomplish this function is straightforward. However, the general DEH parameter display requires a coded address to access the proper quantity in the various COMMON areas. This coding is necessary because the format of the displayed variable may be logical, integer or real (floating point); in addition, the variable may reside in the base DEH area, and thus exist in all systems, or it may reside in the AUTOMATIC TURBINE STARTUP area, and thus be an option which may or may not exist in all systems.

To accommodate these various situations, a dictionary addressing scheme has been designed which will provide access to every combination of variables. In this scheme all addresses are composed of four digits, each of which may validly range from 0 through 9. The most significant digit is coded to indicate the desired variable format (logical, integer or real) and the storage area (base DEH or ATS). The three least significant digits simply point to the relative location of the variable in either the base DEH or the ATS COMMON area.

The following table lists the address structure. The symbols XXX represent relative location in COMMON area and are completely catalogued in the dictionary portion of the operating instructions. The remaining most significant digit and its definition are tabulated.

ADDRESS STRUCTURE

| Address | Definition |
|---|---|
| 1XXX | Base DEH system - logical variable |
| 2XXX | Base DEH system - integer variable |
| 3XXX | Base DEH system - real variable |
| 4XXX | Base DEH system - real constant which may be changed from keyboard under special conditions |
| 5XXX | ATS system - logical variable |
| 6XXX | ATS system - integer variable |
| 7XXX | ATS system - real variable |
| 8XXX | ATS system - real temperature variable |
| 9XXX | ATS system - real pressure variable |

Under normal conditions, the program is bid once a second by the AUX SYNC task. However, when the operator presses a panel pushbutton to request a new display, a separate path to the VISUAL DISPLAY task is taken. the pushbutton generates a panel interrupt which is serviced by the Monitor; this results in the PANEL INTERRUPT program being executed, and after decoding the pushbutton pressed the PANEL program runs. The PANEL task responds by setting appropriate flags and counters, and then bids the VISUAL DISPLAY task.

Whether called from the AUX SYNC or the PANEL task, the VISUAL DISPLAY program performs its functions the same way. It first checks the appropriate flags and counters previously set, decodes these, selects the proper numerical value from core storage, and then manipulates this value to the correct form. Then the VISUAL DISPLAY task sets up a contact output pattern for the number to be displayed and gates this to the display hardware.

The VISUAL DISPLAY program first reacts to a group of variables which have been set by the PANEL task, and then VISUAL DISPLAY creates another group of variables which will place the proper values in the windows. Concerning those variables generated by the PANEL program, IPBX indicates which display pushbutton has been pressed as shown in FIG. 11. INDEX1 and INDEX3 are flags which indicate special action; INDEX1 means a VALVE STATUS or PROGRAM DISPLAY pushbutton has been pressed and thus both display windows should be cleared preparatory to additional keyboard entries; INDEX3 indicates a dedicated pushbutton has been pressed and new values for the dedicated variable are being entered from the keyboard. DATENTRY and DADR are flags associated with changing DEH system constants while INDEX2 is a relative location in a COMMON area indicated by the symbols XXX in the above table.

The DEH system state (BR) is necessary when displaying REFERENCE in order to place the MW or SPEED message in the left-most windows. The state ATS is required when displaying REFERENCE and ACCELERATION RATE since these quantities are set by the ATS program, rather than from the keyboard, when the turbine is being accelerated by computed values from ATS. The state GC is necessary when displaying VALVE POSITION LIMIT since the limited quantity depends on whether the turbine is on throttle or governor control. The DEH system variables, such as REFERENCE, DEMAND, RATES and LIMITS are accessed from appropriate COMMON areas through the use of INDEX2.

LOGIC TASK

Go Logic

When the DEH system is on operator automatic control, the turbine speed/load (DEMAND) is entered from the keyboard. The operator then may allow the turbine reference to adjust to the demand by pressing the GO pushbutton. When the operator does this, the GO lamp is turned on and logical states are set to begin moving the reference in the CONTROL task. When the reference equals the demand, the GO lamp is turned off. The GO logic detects the various conditions affecting the GO state and sets the status and lamp accordingly.

The GO pushbutton (GOPB), which is updated by the PANEL task, is the set signal for the GO flip-flop. The reset or clear signal, which will override the set signal, can occur from a number of different conditions as follows: the HOLD pushbutton (HOLDPB) as updated by the PANEL task, a computed hold condition (HOLDCP) as set by the CONTROL or LOGIC tasks, the DEH system not being in operator automatic control (OA) or in the maintenance test condition (OPRT) (during which the system may be used as a simulator/-trainer), or the condition in which the reference has reached the demand and the CONTROL task sets the GOHOLDOF state to clear the GO lamp.

HOLD LOGIC

When the DEH system is an operator automatic control, the turbine speed/load (DEMAND) is entered from the keyboard. The operator may then inhibit the turbine reference from adjusting to the demand by pressing the HOLD pushbutton. When the operator does this, the HOLD lamp is turned on and logical states are set to prohibit the reference from moving in the CONTROL task. The HOLD logic detects the various conditions affecting the HOLD state and sets the status and lamp accordingly.

The HOLD pushbutton state (HOLDPB), which is set by the PANEL task, or the hold state (HOLDCP) computed by the CONTROL or LOGIC tasks, acts as the set signal for the HOLD flip-flop. The reset or clear signal, which will override the set signal, can occur from a number of different conditions as follows: the DEH system not being on operator automatic control (OA) or in the maintenance test condition (OPRT) (during which the system may be used as a simulator/-trainer), the GO flip-flop being set and thus overriding the HOLD state, or the condition in which the reference has reached the demand and the CONTROL task sets the GOHOLDOF state to clear the HOLD lamp. The HOLD logic program then resets the computed hold state (HOLDCP) and the GOHOLDOF state, so that they may be used in future decisions by the CONTROL and LOGIC tasks.

PANEL TASK

The PANEL task is assigned priority level $C_{16}(12_{10})$ and is bid by the PANEL INTERRUPT program when a button is pressed.

Figure 16:
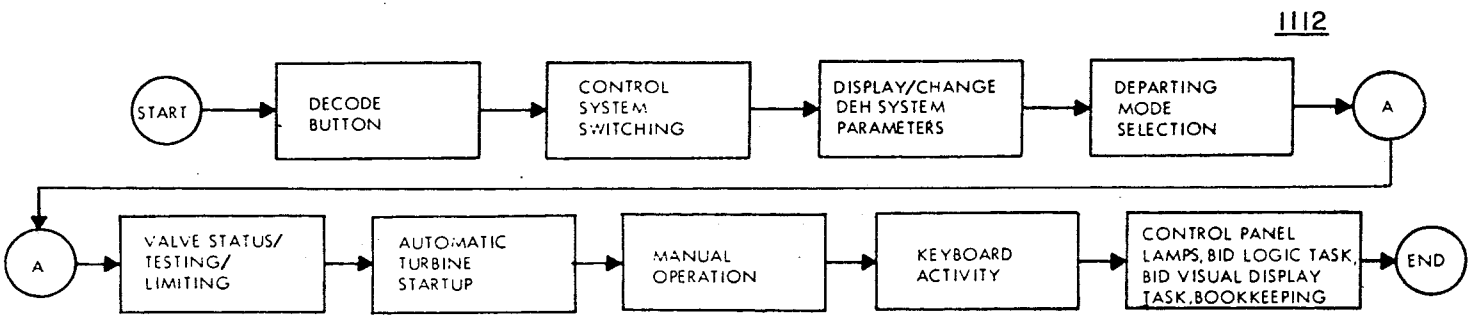
FIG. 16 is a block diagram of a panel program which is operable in accordance with the principles of the invention.

FIG. 16 shows a block diagram of the major functions performed by the PANEL task. These include executing each of the button group functions discussed above, as well as additional decisions, checks, and bookkeeping necessary to properly perform the action requested by the operator.

BUTTON DECODE

The BUTTON DECODE program examines the button identification (IPB) provided by the PANEL INTERRUPT program, and transfers to the proper location in the PANEL task to carry out the action required by this button. The program also does some bookkeeping checks necessary to keep the panel lamps in the correct state. A total of 54 buttons can be decoded in the current version of the DEH PANEL task.

The identification of the last button (IPBX), which had been pressed and which has associated with it a visual display mode lamp, is stored in a temporary integer location (JJ) for later use in turning off the last lamp. Then the current button identification (IPB) is checked to determine if it represents the ENTER pushbutton; if so, a special logical variable ENTERPB is reset for later use should the ENTER button be pressed two or more consecutive times. This has been found to be a rather common operator error and is flashed as an invalid request. The program then simply executes a FORTRAN computed GO TO statement and transfers to the appropriate portion of the PANEL task.

CONTROL SYSTEM SWITCHING

There are six buttons on the Operator's Panel which may switch control states of the DEH system. A brief description of each follows:

1. TRANSFER TV/GV - This button initiates a transfer from throttle valve to governor valve control during wide-range speed operation. The pushbutton has a split lens. When control is on the throttle valves, the upper half of the lens is backlighted. When the button is pressed, to transfer control, the entire lens is backlighted. At the completion of the transfer, only the bottom half of the lens remains on. Once the DEH system is on governor control, it stays in this mode until the turbine istripped and relatched. At this time, it is again in throttle valve control.
2. IMPULSE PRESSURE FEEDBACK IN/OUT - This is a push-push button with split lens. It places the impulse pressure feedback loop in or out of service, with appropriate backlighting of the button lens.
3. MEGAWATT FEEDBACK IN/OUT - This is a push-push button with split lens. It places the megawatt feedback loop in or out of service, with appropriate backlighting of the button lens.
4. SPEED FEEDBACK IN/OUT - This split lens button places the speed feedback loop in service in the DEH system. Normally the speed loop is always in service; however, when the DEH control task detects a speed channel failure condition in which all speed input signals are unreliable, the speed feedback loop is disabled and the speed channel monitor lamps turned on. When the speed inputs become reliable, the monitor lamps are turned off, thus indicating to the operator that he may place the speed feedback loop back in service. As long as the speed signals are reliable, the operator cannot take the speed loop out of service.
5. THROTTLE PRESSURE CONTROL IN/OUT - This is a push-push button with split lens which places the throttle pressure controller in or out of service, with appropriate backlighting of the lens.
6. CONTROLLER RESET - The button restores the DEH system to an active operating state after the computer has been stopped due to a power failure or hardware/software maintenance.

The logical variable TRPB is set when the TRANSFER TV/GV button is pressed. The impulse pressure, megawatt, and throttle pressure logical states (IPIPB, MWIPB and TRCPB respectively) are set to the logical inverse of their previous state when the corresponding buttons are pressed. This is the mechanism which provides the push-push nature of these buttons. The logical variable SPIPB is set when the speed feedback button is pressed. Finally, each of these buttons initiate a bid for the LOGIC task by setting the RUNLOGIC variable prior to exit from the PANEL task.

The CONTROLLER RESET button is handled somewhat differently. The state CRESETPB is set by the STOP/INITIALIZE task, which does cleanup and initialization after a computer stop condition. The CRESETPB is checked; if it is not set, the computer has been running, and thus the button pressed is ignored. If CRESETPB is set, this means the computer had been stopped; CRESETPB is reset and the lamp behind the button is turned off. In addition, the PANEL task effectively presses the speed feedback button by setting the logical state SPIPB. This is done so that the DEH system restarts after a power failure or other computer stop condition with the speed feedback loop in service. The LOGIC task is requested to run by setting the RUNLOGIC state. The REFERENCE display button is also effectively pressed so that the display windows always start out in the same mode after a stop condition on the computer.

DISPLAY/CHANGE DEH SYSTEM PARAMETERS

Eight buttons allow the operator to display or change various DEH system parameters. Six of these buttons are dedicated to the display or change of a single important parameter for each button. The remaining two buttons provide the ability to display or change a group of DEH system variables from each button. In addition, two special buttons (GO and HOLD) are intimately associated with one of the dedicated display/change buttons, and thus are also included in this discussion.

Before listing each of these buttons, a brief description of the display window mechanism is given. The DEH Operator B Panel contains two digital displays which are provided with five windows each. The left display, labeled REFERENCE, has two major functions. It either presents numerical information which currently exists in computer memory for the six dedicated buttons mentioned above, or it accepts address inputs from the keyboard for the two buttons assigned to display or change groups of DEH system variables. The right display, labeled DEMAND, also has two major functions. It wither accepts keyboard inputs in preparation for changing any of the currently existing numerical information in computer memory for the six dedicated buttons mentioned above, or it presents currently existing information in computer memory for the two buttons assigned to display or change groups of DEH system variables.

Of the five windows in each digital display, the leftmost is reserved for mnemonic characters. These characters combine to form a short message identifying the numerical quantity in the remaining four windows. The following table lists the 11 available messages and an explanation of each. The four right windows in each display provide the numerical digits 0 through 9 and a decimal point where appropriate.

MNEMONIC CHARACTER DEFINITION

| Message | Explanation |
|---|---|
| MW | Megawatt Symbol for Load Control |
| SPEED | Speed Symbol for Speed Control |
| % VALVE POSITION | Percent Valve Position for Valve Status |
| RPM/MIN | Acceleration Rate |
| MW/MIN | Load Rate |
| SYS PAR | General DEH System Parameter |
| IMP PRESS % | Impulse Pressure in Percent For Load Control |
| PRESS | General Pressure Variable |
| TEMP | General Temperature Variable |
| VALVE NO. | Valve Identification for Valve Status |
| — | Algebraic Negative Quantity |

A brief description of the eight buttons associated with display/change as well as the GO and HOLD buttons, follows:

1. REFERENCE - This button initiates a display or change of the DEH reference and demand for speed or load operation. When the turbine is on operator automatic control, new demand values may be entered from the keyboard. However, when the turbine is in a remote operating mode such as automatic synchronizer, dispatch or ACCELERATION program, the demand cannot be changed from the keyboard. Any attempt to do so is flashed as an invalid request.
2. ACCELERATION RATE - This button initiates a display or change of the acceleration rate used on wide-range speed operation. When the turbine is on operator automatic control, this value is entered by the operator, and may be changed from the keyboard. However, when the turbine is being accelerated by an AUTOMATIC STARTUP program, the displayed value is the rate selected by this program and cannot be changed from the keyboard. Any attempt to do so is flashed as an invalid request.
3. LOAD RATE - This button initiates a display or change of the load rate used on operator automatic control. This value may be displayed or changed at any time.
4. LOW LIMIT - This button is an optional feature which initiates a display or change of the low load limit used on all automatic load control modes. This value may be displayed or changed at any time.
5. HIGH LIMIT - This button is an optional feature which initiates a display or change of the high load limit used on all automatic load control modes. This value may be changed at any time. Each of these buttons have high or low limits, whichever is appropriate, associated with them when changes are to be made in the values discussed above. Violation of these limits from a keyboard entry is flashed as an invalid request and the entry is ignored. More details of these limits are discussed in a later section where the KEYBOARD program is described.
6 VALVE POSITION LIMIT - This button initiates a display of the governor valve position limit and the quantity being limited. Change or adjustment of the valve position limit is accomplished by raise/-lower buttons (described in a later section where the valve buttons are discussed). Any attempt to enter values from the keyboard in this display mode is flashed as an invalid request.

7. VALVE STATUS - This button initiates a display of the status (position) of the turbine throttle and governor valves. Thus, this button is associated with a group of DEH system variables. A description of the steps necessary to carry out this display function is given in later paragraphs (where the valve buttons are discussed).
8. TURBINE PROGRAM DISPLAY - This button initiates a display or change of any DEH system parameter not otherwise addressable with one of the unique buttons described above. These variables include pressures, temperatures, control system tuning constants, and calculated quantities in all parts of the DEH system. A dictionary is provided so that the address of such quantities may be entered from the keyboard. Further discussion of these points is given in later paragraphs where the keyboard is described.
9. GO - This button initiates a special DEH CONTROL program to adjust the turbine reference. The program ultimately positions the valves on operator automatic control. The reference then moves at the appropriate load or acceleration rate until the reference and demand are equal. The updated reference value is continually displayed in the REFERENCE windows so that the operator may observe it changing to meet the demand, which is displayed in the DEMAND windows.
10. HOLD - This button interrupts the reference adjustment process described above, and holds the reference at the value existing at the moment the HOLD button is pressed. In order to continue the adjustment process on the reference, the operator must press the GO button.

A brief description of the steps necessary to display or change any of the first six variables discussed above follows; description of cases 7 and 8 are withheld until a later section. When the operator wishes to display or change any of the DEH dedicated system parameters, he must execute a sequence of steps which result in the desired action. The steps are listed as follows:

1. The operator presses the appropriate button; the DEH programs display the current value of the parameter in the reference windows while the demand windows are cleared to allow for possible keyboard entry.
2. If the operator wishes only to observe the parameter value, then he does nothing else. The value remains in the reference windows until some new button is pressed.
3. If the operator wishes to change the parameter, he types in on the keyboard the new value which he desires. This is displayed in the DEMAND windows, but will not yet be entered into the DEH programs.
4. If the operator is satisfied with the new value as it appears in the demand windows, he may enter the new quantity into the DEH operating system by pressing the ENTER button. The ENTER button is described in more detail in a later section on the keyboard.
5. If for any reason the operator is not satisfied with the value as it appears in the demand windows, he may press the CANCEL button. The CANCEL button will be described in more detail in a later section on the keyboard. This removes the number from the DEMAND windows and allows the operator to begin a new sequence for the parameter.
6. Assuming that the operator is satisfied with the number and that he presses the ENTER button, the new value of the parameter appears in the REFERENCE window and the DEMAND window is cleared. This is an acknowledgment that the DEH programs have accepted the number and are using the new value from that point on. p1 7. If for any reason the numerical value entered into the DEH system violates preprogrammed conditions (such as high limits less than low limits), the entire operation is aborted and the INVALID REQUEST lamp is flashed.

The above description of data manipulation is modified somewhat when the operator wishes to display or change the turbine reference and demand. Both of these quantities are displayed when the reference button is pressed. During wide-range speed control, the left REFERENCE display contains the turbine speed reference value, while the right DEMAND display contains the turbine speed demand. During load control the REFERENCE display contains the turbine load reference while the demand display contains the turbine load demand.

Since the reference and demand control the turbine valves directly, it is essential that the operator have a unique handle on these quantities so that he may start or stop reference changes quickly and easily. This is accomplished by use of the GO and HOLD buttons in conjunction with the reference button. The GO and HOLD buttons control two reference states in the DEH system, which indicate whether the reference and demand are equal or unequal. When these quantities are equal, both the GO and HOLD backlights are off. When these quantities are unequal, either the GO or the HOLD lamp is on. If the GO light is turned on, the reference is changing to meet the demand value at the selected rate. Should the operator wish to stop the reference adjustment process, he simly presses the HOLD button. The HOLD button then backlights and holds the reference at its current value. When the operator wishes to start the reference moving again, he must press the GO button, which then backlights and enables the reference to adjust to the proper value.

The sequence of steps for displaying or changing the reference follows:

1. The operator presses the reference button. The DEH programs display the current value of reference in the left windows and the current value of demand in the right windows.
2. If the operator wishes to change the demand, he types the new value of the keyboard. This is displayed in the DEMAND windows, but is not yet entered into the DEH programs.
3. If the operator is satisfied with the new value, he presses the ENTER button. This places the new demand value in the DEH programs and turns the HOLD lamp, assuming that the new demand satisfies certain limit checks to be described shortly. If these conditions are not met, the INVALID REQUEST lamp is flashed, the new value is ignored, and the original value is returned to the DEMAND windows.
4. If the operator is not satisfied with the new value (set in Step 3), he simply presses the CANCEL button. The DEH programs then ignore this value and return the original value to the DEMAND windows.

5. If a new demand is finally entered and the HOLD lamp comes on, the operator may start the reference adjusting to this new demand by pressing the GO button. The HOLD lamp is turned off, the GO lamp is turned on, and the reference begins to move at the selected rate toward the demand.
6. At any time, the operator may inhibit the reference adjustment by pressing the HOLD button. He may then restart the reference adjustment by pressing the GO button.
7. When the reference finally equals the demand both the GO and HOLD lamps will be turned off.

Each of the eight display buttons set the integer pointer (IPBX) to its assigned value and the appropriate panel lamps are turned off and on. IPBX is then checked by the VISUAL DISPLAY task, which selects the numerical values from computer memory and displays then in the windows.

The TURBINE PROGRAM DISPLAY button also resets a few logical states in preparation for keyboard entries. These are discussed in later paragraphs on the keyboard description. The remote control modes AS, ADS and ATS for the Automatic Synchronizer, Dispatch System and TURBINE STARTUP program are checked, along with the manual control state (TM) if the maintenance test switch (OPRT) is not set. All of these modes exclude the possibility of the GO and HOLD buttons being active, so these buttons are ignored in these states and the PANEL program simply exits. However on operator automatic control, the HOLD button state (HOLDPB) is set, or the GO button state (GOPB) is set. In the latter case, HOLDPB is also reset. The LOGIC task is requested to run by setting the RUNLOGIC variable, and the program then exits.

OPERATING MODE SELECTION

There are five buttons which may be used to select the turbine operating mode. When any of these are pressed, they initiate major operating changes in the DEH Control System, assuming the proper conditions exist for the mode selected. A brief description of these buttons follows:

1. OPERATOR AUTOMATIC (OPER AUTO) - This button places the turbine in automatic control with the operator providing all demand, rate, and set point information from the keyboard. If the turbine had been previously in manual control, the OPER AUTO lamp must be flashing to indicate that the DEH system is ready to accept automatic control; otherwise pressing the OPER AUTO button is ignored. If the turbine had been in one of the remote control modes listed below, then pressing the OPER AUTO button rejects the remote and returns automatic control to the operator.
2. AUXILIARY SYNCHRONIZER (AUTO SYNC) - This button allows automatic synchronizing equipment to synchronize the turbine generator with the power system by indexing the speed demand and reference with raise/lower pulses, in the form of contact inputs.
3. AUTOMATIC DISPATCHING SYSTEM (ADS) - This button allows automatic dispatching equipment to operate the turbine generator by setting the load demand and reference. A number of dispatching options are available, including raise/-lower pulses, raise/lower pulse-width modulation, and analog input values to set the reference.
4. AUTOMATIC TURBINE STARTUP (TURBINE AUTO START) - This button allows a special computer program to automatically start up and accelerate the turbine during wide-range speed control. The program may reside in the DEH computer or it may exist in another computer in the plant or at a remote location.
5. COMPUTER DATA LINK (COMP DATA LINK) - This optional button allows another computer, either in the plant or at a remote location, to provide all demand, rate, and set point information to the DEH system.

The OPER AUTO button resets the remote mode button states (ASPB, ADSPB and AUTOSTAR) for Automatic Synchronizer, the Automatic Dispatch System, and the AUTOMATIC TURBINE STARTUP program, respectively. Since the operator automatic state (OA) is merely the logical inverse of the turbine manual state (TM), the PANEL task cannot actually set OA, but can only request the LOGIC task to run, by setting the RUNLOGIC variable. The LOGIC program then determines whether or not operator automatic is accepted by the manual backup system.

The remote buttons set their corresponding push-button states after which RUNLOGIC is set. As in the case of operator automatic, the LOGIC task then determines if the requested mode will be accepted.

The data link button is handled somewhat differently; this is a push-push button whose state (DLINK) is given the logical inverse of its previous value at statement 14. The new state is then interrogated in order to determine whether to turn the button backlight on or off, after which the program exits.

VALVE STATUS/TESTING/LIMITING

Nine buttons on the Operator's Panel are used for displaying valve status, testing the throttle and governor valves, and displaying or changing the valve position limit. Some of these buttons are used in more than one of these areas. A brief description of the three buttons associated with display of valve status follows:

1. VALVE STATUS - This button initiates a display of the status (position) of the turbine throttle and governor valves.
2. TV - This button provides the mechanism for the throttle valve status (position) to be displayed.
3. GV - This button provides the mechanism for the governor valve status (position) to be displayed.

In order to display valve status, the operator must execute the following sequence of steps:

1. Press the VALVE STATUS button, which then backlights.
2. Press either the TV or the GV button, depending on which group of valves are to be displayed; the TV or GV lamp then lights.
3. On the keyboard, press the key corresponding to the number of the valve to be displayed; this valve then appears in the left windows.
4. Press the ENTER button. The DEH programs then place the valve position in percent in the right windows, and continually update this value as the valve position changes.
5. If the valve number entered on the keyboard in Step 3 is out of range of the existing valves on the turbine, the INVALID REQUEST lamp is flashed and both display windows are cleared. The operator then should press the CANCEL button, and begin again at Step 3.

A brief description of the four buttons associated with valve testing follows:

1. VALVE TEST - This button initiates a sequence of steps which results in throttle/governor valve testing.
2. TV - This button indicates that the turbine throttle valves are to be tested.
3. CLOSE - This button provides the mechanism for gradually closing the governor valve associated with the throttle valve to be tested.
4. OPEN - This button provides the mechanism for gradually opening the governor valve associated with the throttle valve which has just been tested.

To understand the need for valve testing, one must realize that steam turbines have two sets of valves for control of steam flow. The throttle valves are located upstream in the steam flow path and the governor valves are downstream.

Under most turbine operating conditions, the throttle valves are wide open and the governor valves assume the correct position to control steam flow. However, the throttle valves must always be prepared to close instantly in case a contingency occurs which requires a mandatory trip of the turbine. If either or both of the throttle valves remain open under such an emergency condition, the possibility of severe damage to the turbine and power plant is very high.

In order to demonstrate that the throttle valves are operable, the valve test feature is made available. Essentially this feature allows the operator to close the throttle valves for a few seconds to assure their operational availability during contingencies. However, in certain steam chest arrangements, a complication arises in the incorporation of a throttle valve test function. With normal steam flow through the throttle vlve, mechanical forces acting on the throttle valve mechanism are so large that it is physically impossible to reopen the valve and thus verify its operational availability. To overcome this problem, it is necessary to close the governor valve on the same side of the turbine (in small incremental steps) so that load on the turbine is not upset to any great degree. When the governor valve is essentially closed and steam flow cut off, the throttle valve forces are negligible and the throttle valve may be test-closed and reopened to verify its operation. Finally, the governor valve must then be opened incrementally to return it to the conditions prior to the test.

In order to carry out a throttle valve test, the operator must execute the following sequence of steps:

1. Press the VALVE TEST button, which then backlights; the VALVE STATUS lamp also backlights if it is not already on.
2. Press the TV button, which then backlights.
3. On the keyboard, press the key corresponding to the number of the throttle valve to be tested. This number then appears in the left windows.
4. Press the ENTER button. The DEH programs then place the governor valve position, corresponding to the throttle valve being tested, in the right windows. This value is continually updated as the test proceeds.
5. Should the valve number entered on the keyboard in Step 3 be out of range of the existing valves on the turbine, the INVALID REQUEST lamp is flashed and both display windows are cleared. The operator then presses the CANCEL button and begins again at Step 3.
6. Press and hold the CLOSE button. The DEH valve test system then closes the appropriate governor valve at a controlled gradual rate; the right display windows show the governor valve position as it decreases throughout this part of the test. The lamps behind the CLOSE and OPEN buttons turn on and remain on until the test is complete. When the governor valve is within 5 percent of its closed position, the throttle valve immediately closes and stays closed as long as the CLOSE button is held down.
7. Release the CLOSE button. The throttle valve opens, but the governor valve remains closed. Pressing the CLOSE button again quicly recloses the throttle valve, if another operational check is desired. As many reclosures as necessary may be carried out at this stage of the test.
8. Press and hold the OPEN button. The DEH valve test system then opens the appropriate governor valve at the same controlled gradual rate. The right display windows show the governor valve position as it increases continually throughout this part of the test. When the governor valve is returned to its original position, the lamps behind the CLOSE and OPEN buttons go out, thus indicating the completion of the valve test.
9. It is not necessary to hold down the CLOSE and OPEN buttons continuously during the valve test. They may be released at any time and the test will simply be suspended; then a short while later, the buttons may be pressed and held and the test will continue.
10. It is perfectly valid to use the other visual display buttons during the temporary suspension of a valve test. When it is desired to return to complete or continue the valve test, it is necessary only to press the VALVE TEST button. The DEH system then retrieves from memory all the information needed to continue the test (including the valve number and position of governor valve for the display windows) so that the test procedure may be continued from that point.

A brief description of the three buttons associated with the valve position limit display and change function follows:

1. VALVE POSITION LIMIT DISPLAY - This button initiates a display of the current value of the valve position limit setting in the left windows, and the DEH governor valve quantity being limited in the right windows.
2. VALVE POSITION LIMIT LOWER - This button is used to lower the valve position limit setting as long as the button is held down.
3. VALVE POSITION LIMIT RAISE - This button is used to raise the valve position limit setting as long as the button is held down.

The rate of adjustment of the valve position limit setting is controlled by a keyboard entered constant. As long as the raise or lower button is held down, the setting is varied at an exponential rate. In order to make small changes in the limit, the operator simply presses and holds the appropriate button for a few seconds and then releases the button. He may do this more or less continuously, and the value of the limit is displayed in the left windows. In order to adjust the valve position limit setting with the raise and lower buttons, it is first necessary to press the VALVE POSITION LIMIT DISPLAY button. If it is not pressed, the raise and lower buttons are ignored. The display button acts as a permissive for varying the limit setting.

The program sets the state VSTATUS for this button and sets the integer pointer IPBX to 8 for this visual display mode. The program handles the TV and GV buttons, respectively. The VSTATUS state is checked; if it is not set, the TV and GV buttons are ignored. Otherwise, the TV and GV logical states are set and the lamp behind the button pressed is turned on by a call to the contact output handler. The VALVE TEST button is processed and the manual control state (TM) is checked. If the turbine is in manual operation, the valve test cannot be carried out and the test button is ignored. However, in automatic control, the logical state VTESTPB is set and the lamp behind the button is turned on. Then the integer NVTEST representing the valve to be tested is checked. If the value is non-zero, a test has been previously started, so the test conditions are immediately set up from memory. This includes setting the TV button state and lamp, and setting the pointer INDEX2 equal to NVTEST so that the visual display of governor valve position in the right windows may be properly selected. Should the value of NVTEST be zero, the VALVE STATUS lamp is set. The system then waits for more keyboard information from the operator.

The VALVE POSITION LIMIT DISPLAY button is serviced; this requires setting the pointer IPBX to 6 for a visual display. The valve test button (VTESTPB) and the TV buttons must have been previously pressed, and the valve number which is to be tested (which is stored in location INDEX2) must be valid; otherwise the CLOSE or OPEN button is ignored. If these conditions are met, the open button state (OPENPB) is set if this button is pressed, while the close button state (CLOSEPB) is set if this is the button pressed. In addition, a contact output to actuate the governor valve closing circuitry is set if the CLOSE button is pressed. Finally, the valve being tested NVTEST is set equal to INDEX2.

The VALVE POSITION LIMIT RAISE and LOWER buttons are serviced. If the display pointer IPBX is not equal to 6, the VALVE POSITION LIMIT DISPLAY button has not been pushed; therefore, the raise and lower buttons are ignored. If IPBX equals 6, the appropriate state VPLRPB or VPLLPB is set and the program exits.

AUTOMATIC TURBINE STARTUP

Five buttons are associated with the automatic turbine startup feature of the DEH system. A brief description of these buttons follows:

1. AUTOMATIC TURBINE STARTUP (TURBINE AUTO START) - This button allows a special computer program to automatically start up and accelerate the turbine during wide-range speed control.
2. TURBINE SUPERVISION OFF - This is a push-push button which controls the printout of messages from the turbine supervisory programs. Normally, the messages are always printed; the operator may suppress printing by pressing this button, which then backlights. Should the messages be desired later, then the button may be pressed again; the lamp is turned off and the supervisory messages are printed on the typewriter.
3. OVERRIDE ALARM - This button overrides certain alarm stops which the AUTOMATIC TURBINE STARTUP program may detect. When this happens, the program waits for operator action before proceeding with the acceleration. If the operator decides to continue the startup, he presses the OVERRIDE ALARM button.
4. OVERRIDE SENSOR HOLD - This button overrides certain analog input sensor stops, which the AUTOMATIC TURBINE STARTUP program may detect. When this happens, the program waits for operator action before proceeding with the acceleration. If the operator decides to continue the startup, he presses this button.
5. RETURN SENSOR TO SCAN - This button returns certain analog inputs to scan after their sensor has been repaired. Should a sensor fail, the AUTOMATIC TURBINE STARTUP removes the corresponding input from scan; when the sensor is detected valid again, this button is backlighted to notify the operator. He then presses the button to return the input to its normal scan.

MANUAL BUTTONS

Six buttons on the Operator'Panel are associated with manual operation of the turbine. Even though the DEH PANEL program does not interface directly with these buttons, a brief description of their function is given for completeness. In general, these buttons allow the operator to control the position of the turbine throttle and governor valves directly from the panel.

1. TURBINE MANUAL - This button places the turbine under manual control of the operator, with the transition from automatic being achieved essentially bumplessly.
2. TV LOWER - This button lowers, or decreases, the throttle valves at a fixed rate as long as the button is held down.
3. TV RAISE - This button raises, or increases, the throttle valves at a fixed rate as long as the button is held down.
4. GV LOWER - This button lowers, or decreases, the governor valves at a fixed rate as long as the button is held down.
5. GV RAISE - This button raises, or increases, the governor valves at a fixed rate as long as the button is held down.
6. FAST ACTION - This button opens or closes the throttle and governor valves, at a fast rate, in manual control. The FAST ACTION button must be held down at the same time as any of the TV or GV RAISE/LOWER buttons described above to achieve the fast action effect.

KEYBOARD ACTIVITY

There are fourteen buttons associated with keyboard activity on the DEH Operator's Panel. Of this total, eleven are numerical keys; these include the integers 0 through 9 and a decimal point. Three additional buttons are available for use with the keyboard to aid in data display or change. A brief description of these buttons follows:

1. NUMERICAL BUTTONS 0 THROUGH 9 - When the operator keys in numbers of these buttons, the corresponding values are displayed in the reference or demand windows, whichever are appropriate, for the function being performed. The values move from right to left in the windows as new keys are pressed, and both leading and trailing zeros are always displayed. If more than four numerical keys are pressed, the left-most value in the windows is lost as the new value is entered in the right-most window, and the remaining values shift left one position.

2. DECIMAL POINT BUTTON - When the decimal point key is pressed, the PANEL program retains this information but does not yet display it. When the next numerical key is pressed, both the value and the decimal point appear in the right-most window. The decimal point is positioned in the lower left-hand corner of the window position. Should additional numerical keys be pressed, the decimal point moves one position to the left with the number with which it was originally entered. Should the decimal point be shifted out of the left-most window it is lost, and a new point may be entered.
3. ENTER - When this button is pressed, the PANEL program enters the value residing in the reference or demand windows, whichever is appropriate, into core memory and performs the correct action requested by the keyboard activity. This action may consist of visual display, parameter change, or intermediate steps in a sequence of operations as described in preceding sections.
4. CANCEL - When this button is pressed, the PANEL program clears both the reference and demand windows, deletes any intermediate values in computer memory, and aborts the entire sequence of operations which was canceled. The operator may then begin a new sequence of steps.
5. CHANGE - This button indicates a sequence of operations necessary to alter numerical values residing in the DEH system memory. The steps necessary to change parameters are described earlier.

The decimal point key and keys 0–9 are serviced to check the validity of the requested entry and to set the entry if it is valid. Among other checks, a check is made on the integer IPBX, which represents the visual display and change button which has been previously pressed. If this value equals 2, thus indicating the acceleration rate button has been pressed, and the Automatic Turbine Startup mode (ATS) is in control, all keyboard buttons are invalid. During the ATS mode the acceleration rate is controlled by the startup program, and thus may be visually displayed but cannot be changed from the keyboard.

Should the ATS state be satisfied, the pointer IPBX is checked to determine if it is equal to 6; if so, the keyboard entry is flashed as invalid because this represents the valve position limit display mode, which cannot use the keyboard. If this situation is all right, the valve test button state (VTESTPB) is checked; should VTESTPB be set and the valve being tested NVTEST is non-zero, the keyboard entry is invalid. This is because NVTEST indicates that some valve has already been selected for test, thus implying that no further keyboard activity is necessary.

Finally, some special tests are made if IPBX equal 1; this means the reference display mode has been selected. If this is the case, all remote control modes such as Automatic Synchronizer (AS), Automatic Dispatch System (ADS), and Automatic Turbine Startup (ATS), imply that the keyboard cannot be used during reference display. Thus these result in the INVALID REQUEST lamp being flashed. In addition, should the turbine be on manual control (TM) or unlatched (NOT ASL), and not in the maintenance test mode (OPRT), then keyboard activity is also invalid during reference display. All of these cases are invalid for keyboard entry because the turbine demand and reference are set by the remote mode or the manual tracking system. The only time that the operator may use the keyboard in the reference display mode is during operator automatic control or during the maintenance test condition in which the DEH system is being used as a simulator and trainer.

Should all of these tests be passed properly, the logical state KEYENTRY is set and the numerical value in location KEY is checked. This is the keyboard button which has just been pressed, and must lie between 0 and 9 inclusive; otherwise, the entry is flashed as invalid. For a valid value of KEY, the program then places the new number in its proper position in the integer array (IW). This array has a place for each of the four window positions of the visual display and, as keyboard buttons are pressed, the entries move down one positon in IW and the latest key is entered in the top position. The pointer ID maintains the proper position for each new key. Thus, if ID equals 0, this means there are no entries in the array IW. The value KEY is thus placed in the first position of IW. However, if ID is not zero, then a FORTRAN DO loop is executed to move the entries in IW down one position prior to entering the new value of key in the first position at statement 414. Then the value of the pointer ID is checked again; if it is less than 3, it is incremented by 1. If it is equal to 3, it retains that value. This is the mechanism used to accept more than four keyboard values with only the last four key entries being retained.

CONTROL TASK

Valve Position Limit Function

A valve position limit function is a traditional feature of turbine control system. This function generally provides the operator with high limiting action on the final computer governor valve output to the servo actuator. It is most useful when the turbine is on automatic control, and allows the operator to override the automatic output if he feels a particular situation justifies such action.

In the DEH Control System, the valve position limit feature is active on both speed and load control. The valve position limit is normally adjustable in both the rise and lower direction; when the governor valves are actually being limited by this function, the VALVE POSITION LIMIT DISPLAY button is flashed to alert the operator to the condition. The computed value (SPD) is the governor valve position set by the Speed Control System, while GVPOS is the governor valve position set by the Load Control System. Each output is high limited by the valve position limit (VPOSL) which is continuously adjustable by raise and lower pushbuttons on the Operator's Panel.

When the valve position limit is adjusted with the raise or lower buttons, the rate of change of VPOSL is controlled by a keyboard entered constant (VPOSLINC), the valve position limit increment. The actual variation of VPOSL is a nonlinear function of the time in seconds which the raise or lower button is pressed and held. Basically, the valve position limit is incremented every 1 sec by an amount given by the expression (N * VPOSLINC), where N is the running number of consecutive seconds during which the raise or lower button is held down. Once the button is released, N is reset to zero and is counted up when either the raise or lower button is pressed again. By pressing and releasing these buttons, the operator may incrementally vary the valve position limit in a variety of ways.

When the raise or lower button is initially pressed, the PANEL INTERRUPT program decodes these buttons and bids the PANEL task. This program then sets logical states, if the proper conditions exist, to begin a time counter in the AUX SYNC task. The AUX SYNC task counts in 1/10 sec steps, as long as the raise or lower button is held down. Simultaneously, the CONTROL program runs every 1 sec and increments the valve position limit according to the count set by the AUX SYNC task.

When the raise or lower button is released, the valve interrupt is triggered. The Monitor then runs the VALVE INTERRUPT program, which resets the valve position limit logical states and time counter so that the valve position limit incremental action is no longer executed in the control task. Pressing the raise or lower button again repeats the cycle described.

A test is first made to determine if the limit is to be raised or lowered as indicated by raise pushbutton state (VPLRPB), or by a request from the AUTOMATIC TURBINE STARTUP (ATS) program through an equivalent raise logic state (ATSVPLPB-assuming that the limit VPOSL is below its maximum value VPOSLMAX). If the limit is to be raised, a temporary location is set to the incremental change (VPOSLINC). If the limit is not to be raised, a test is made to determine if the limit is to be lowered as indicated by the lower button state (VPLLPB). If so, a temporary location is set with the negative incremental change (VPOSLINC); if there is no lower action, the program moves on to the next stage.

If some changes is to be made in the limit, the program computes the incremental step as discussed above and adds this to the last value of VPOSL. Finally, tests are made to be sure that the limit does not exceed a maximum value (VPOSLMAX, a keyboard entered constant) or go below zero. The program then moves on to the next stage.

VALVE CONTINGENCY FUNCTION

In situations where the throttle and governor valves are asked to move very fast, such as the transfer from throttle to governor valve control or when load is changed at a high rate, the VALVE CONTINGENCY program flashes the valve status lamps for a few seconds. This is a normal situation which simply indicates that the valve servo actuator cannot move quite as fast as the DEH system has called for. The lamps flicker briefly and then go out when the LVDT signals catch up to the computer output.

The valve contingency function has a second feature which is executed during automatic control to alert the operator to situations during which the analog backup system 1016 is not tracking the DEH controller valve analog outputs. Under normal conditions, the backup system continuously tracks the computer outputs to assume control bumplessly at any time. However, in certain situations, when the automatic system makes fast valve movements, such as during throttle/governor transfer or large load changes at a high rate, the manual backup tracking system lags for a short interval of time. The valve contingency function indicates this condition by flashing the MANUAL NOT TRACKING monitor lamp on the Operator A Panel. The tracking deadband is a keyboard entered constant for the throttle and governor valves individually; these are normally set at about 1 percent. While the MANUAL NOT TRACKING lamp is flashing, the operator must not transfer to manual control; otherwise, he may sustain a significant bump in the operating conditions and may even place the turbine in an unsafe operating state. In the preferred embodiment, the tracking deadband or discrepancy is a keyboard entered constant individually selectable for each throttle valve TV1, TV2, TV3, TV4 and each governor valve GV1 through GV8. The discrepancy values or deadbands are normally set at about 1%.

The valve contingency function interfaces with the remaining portions of the DEH Control System primarily through the appropriate analog inputs and keyboard entered constants discussed above. Otherwise the function is more or less self-contained.

In the VALVE CONTINGENCY program, all contingency states are reset and the manual control cntact input (TM) is interrogated. If the turbine is on manual, nothing else is done in the contingency program. However, if the turbine is on automatic control, a FORTRAN DO loop is executed to evaluate the throttle and governor valve LVDT inputs with respect to the computer outputs. The throttle inputs are stored in the array ITVSS while the governor inputs are in array IGVSS. The throttle contingency deadband is at TVDB and the governor contingency deadband is at GVDB. If either contingency exists, the appropriate contingency state is set for flashing; otherwise no further action is taken.

A similar test is made for the manual not tracking situation. The throttle and governor valve analog outputs (ITVAO and IGVAO) are checked against the manual backup system outputs (ITVMAN and IGVMAN), with deadbAnds TVMANDB and GVMANDB respectively. If a discrepancy exits, the manual not tracking state is set for flashing; otherwise no action is taken and the program proceeds to the next section.

DEH DIGITAL TREND UPDATE PROCEDURE

The digital trend feature provides the ability to print up to 19 DEH system variables. These quantities may be printed at one time, or they may be printed periodically at a controllable rate by setting certain constants from the keyboard. A brief description of the entry procedure follows:

1. Press the TURBINE PROGRAM DISPLAY button, which then backlights.
2. Key in address 3364 and press the ENTER button. The address appears in the left windows and a numerical value of 0000, 1.000, or 2.000 appears in the right windows, depending on the previous state of the digital trend.
3. Press the CHANGE button; the button backlights and the right windows are cleared.
4. Key in one of the following numerical values, depending on the desired results as listed.
   0 - Suppress the digital trend
   1 - Print the digital trend values one time
   2 - Print the digital trend values periodically at the frequency to be described below
5. Press the ENTER button. The CHANGE lamp goes out and the digital trend requested in Step 4 is carried out. If a periodic trend has been requested, the time in seconds between printing of the values must be entered as follows:

1. Press the TURBINE PROGRAM DISPLAY button, which then backlights.

2. Key in address 3365 and press the ENTER button. The address appears in the left windows and the current value of the digital trend frequency appears in the right windows.
3. To alter the trend frequency, press the CHANGE button. The button then backlights and the right windows are cleared.
4. Key in the new digital trend frequency, in seconds, which will appear in the right windows.
5. Press the ENTER button. The CHANGE lamp goes out and the digital trend frequency requested is carried out.

A note on the frequency of the digital trend is appropriate. The IBM 735 typewriter prints out the 19 values requested, including real time and the address of each value, in about 40 sec. Therefore, this represents the minimum trend frequency; actually the frequency should be kept somewhere in the 120–300 sec range, which is about 2–5 min, or longer. Howerver, it is not necessary to trend all 19 quantities which are available. If fewer quantities are trended, the frequency may be increased somewhat. Good practice would indicate 60 sec, (1 min) as the fastest trend frequency attempted.

The addresses of the 19, or less, quantities to be trended must be entered from the keyboard. The following presents the computer locations which must be given the addresses of the DEH quantities to be trended. In order to alter the variables in the digital trend, the following procedure must be carried out.

1. Press the TURBINE PROGRAM DISPLAY button, which then backlights.
2. Key in the trend location to be altered, as indicated in the following table. As an example, if the fourth variable is to be changed, then key in the number 3369; this appears in the left windows.
3. Press the ENTER button. The current value of the DEH quantity being trended in the fourth column will appear in the right windows.
4. Press the CHANGE button. The button backlights and the right windows are cleared.
5. Key in the address of the new DEH quantity to be trended in the fourth column.
6. Press the ENTER button. The CHANGE lamp is turned off and the new variable appears in the next print of the trend in column 4.

APPENDIX IX

Fortran Programs for the Manual Backup Function, etc. of the DEH and ATS Systems

```
C*****************************************************************************
C
C                    VALVE CONTINGENCY/MANUAL NOT TRACKING PROGRAM
C
C*****************************************************************************
C
46      VSTATCON=.FALSE.
        TVCONT=.FALSE.
        GVCONT=.FALSE.
        MANOTRAK=.FALSE.
        IF(TM) GO TO 50
        DO 48 I=1,2
C
C [illegible] CHECK [illegible] E [illegible] A [illegible] E CP [illegible]INGENCY
C
        TEMP=ITVAO-ITVSS(I)
        IF(ABS(TEMP) .LT. TVDB) GO TO 47
        VSTATCON=.TRUE.
        TVCONT=.TRUE.
C
C [illegible] CHECK G[illegible] A [illegible]E CP [illegible]INGENCY
C
47      TEMP=IGVAO-IGVSS(I)
```

---

```
        IF(ABS(TEMP) .LT. GVDB) GO TO 48
        VSTATCON=.TRUE.
        GVCONT=.TRUE.
48      CONTINUE
C
C [illegible]      CHECK [illegible]A [illegible]ACKI G
C
        TEMP=ITVAO-ITVMAN
        IF(ABS(TEMP) .GE. TVMANDB) GO TO 49
        TEMP=IGVAO-IGVMAN
        IF(ABS(TEMP) .LT. GVMANDB) GO TO 50
49      MANOTRAK=.TRUE.
C
```

```
0197: C*****************************************************************
0198: C
0199: C                    VALVE CONTINGENCY/MANUAL NOT TRACKING PROGRAM
0200: C
0201: C*****************************************************************
0202: C
    0102    EFFD  E8 7 FD          SST  *M:CCO ,B
    0103    000C                   ADL   N1
    0104    0023                   ADL   IPAT
    0105    0011                   ADL   N27
    0106    0004                   ADL   MASK
0203: 45    VSTATCON=.FALSE.
0204:       TVCONT=.FALSE.
0205:       GVCONT=.FALSE.
0206:       MANOTRAK=.FALSE.
```

---

```
0207:       IF(TM) GO TO 50
    0045+B  0000
    0107    2C45  28 4 45          LDA  =X'0000' ,B
    0108    1200  10 2 00          LDC   $+X'0000'
    0109    AE05  A8 6 05          STA   VSTATCON,C
    010A    AE06  A8 6 06          STA   TVCONT,C
    010B    AE07  A8 6 07          STA   GVCONT,C
    010C    AE03  A8 6 03          STA   MANOTRAK,C
    010D    12F1  10 2 F1          LDC   $+X'FFF1'
    010E    2E13  28 6 13          LDA   TM,C
    010F    F200  F0 2 00          ZJP   $+X'0200'
    0110    7546  70 5 46          JMP  *)50 ,B
0208:       DO 48 I=1,2
0209: C

0372: C                    MANUAL - TRACK LOAD CONTROL
0373: C
    0330    7573  70 5 73          JMP  *)70 ,B
0394: 15000 TEMP=IGVMAN-IGVAO
0395:       TEMP=TEMP/40.96
0396:       READY=.FALSE.
0397:       IF(ABS(TEMP) .LT. DBTRKL) READY=.TRUE.
    038E    1200  10 2 00          LDC   $+X'0000'
    038F    2E14  28 6 14          LDA   IGVMAN,C
    0390    4E15  48 6 15          SUB   IGVAO ,C
    0391    EDEE  E8 5 EE          SST  *C01:,B
    0392    AC30  A8 4 30          STA   TEMP,B
    0393    A42F  A0 4 2F          STE   TEMP,B
    0394    EDED  E8 5 ED          SST  *D11:,B
    0395    003B                   ADL  =X'40A3'
    0396    AC30  A8 4 30          STA   TEMP,B
    0397    A42F  A0 4 2F          STE   TEMP,B
    0398    2C45  28 4 45          LDA  =X'0000' ,B
    0399    1200  10 2 00          LDC   $+X'0000'
    039A    AE04  A8 6 04          STA   READY ,C
    039B    EF00  E8 7 00          SST  *ABS ,B
    039C    002F                   ADL   TEMP
    039D    EDEB  E8 5 EB          SST  *S11:,B
    039E    808F                   ADL   DBTRKL
    039F    B200  B0 2 00          FJP   $+X'0000'
    03A0    2C48  28 4 48          LDA  =X'FFFF' ,B
    03A1    1208  10 2 08          LDC   $+X'0008'
    03A2    AE04  A8 6 04          STA   READY ,C
0398:       REFDMD=REFDMD+GR9*TEMP
0399:       IF(REFDMD .GE. MWMAX) REFDMD=MWMAX
    03A3    12D4  10 2 D4          LDC   $+X'FFD4'
    03A4    2E63  28 6 63          LDA   GR9 ,C
    03A5    2662  20 6 62          LDE   GR9 ,C
    03A6    EDEC  E8 5 EC          SST  *M11:,B
    03A7    002F                   ADL   TEMP
    03A8    EDEA  E8 5 EA          SST  *A11:,B
    03A9    607D                   ADL   REFDMD
    03AA    12CA  10 2 CA          LDC   $+X'FFCA'
```

```
    03AB    AE19  A8 6 19          STA   REFDMD,C
    03AC    A618  A0 6 18          STE   REFDMD,C
    03AD    EDEB  E8 5 EB          SST  *S11:,B
    03AE    8000                   ADL   MWMAX
    03AF    BA00  B8 2 00          NJP   $+X'0000'
    03B0    12C7  10 2 C7          LDC   $+X'FFC7'
    03B1    2683  28 6 83          LDA   MWMAX ,C
    03B2    2682  20 6 82          LDE   MWMAX ,C
    03B3    12C1  10 2 C1          LDC   $+X'FFC1'
    03B4    AE19  A8 6 19          STA   REFDMD,C
    03B5    A618  A0 6 18          STE   REFDMD,C
0400: 15500 IF(REFDMD .LT. 0.) REFDMD=0.
    03B6    12BE  10 2 BE   )15500 LDC   $+X'FFBE'
    03B7    2E19  28 6 19          LDA   REFDMD,C
    03B8    2618  20 6 18          LDE   REFDMD,C
    03B9    B200  B0 2 00          NJP   $+X'0000'
    03BA    2C27  28 4 27          LDA  =X'0000' ,B
    03BB    2426  20 4 26          LDE  =X'0000' ,B
    03BC    12B8  10 2 B8          LDC   $+X'FFB8'
    03BD    AE19  A8 6 19          STA   REFDMD,C
    03BE    A618  A0 6 18          STE   REFDMD,C
0401:       ODMD=REFDMD
0402:       TEMP=ITESTAO
0403:       IF(TEMP .GE. TESTAIMX) READY=.FALSE.
    03BF    12B5  10 2 B5          LDC   $+X'FFB5'
    03C0    2E19  28 6 19          LDA   REFDMD,C
    03C1    2618  20 6 18          LDE   REFDMD,C
    03C2    AE01  A8 6 01          STA   ODMD,C
    03C3    A600  A0 6 00          STE   ODMD,C
    03C4    1236  10 2 36          LDC   $+X'0036'
    03C5    2E26  28 6 26          LDA   ITESTAO ,C
    03C6    EDEE  E8 5 EE          SST  *C01:,B
    03C7    AC30  A8 4 30          STA   TEMP,B
    03C8    A42F  A0 4 2F          STE   TEMP,B
    03C9    EDEB  E8 5 EB          SST  *S11:,B
    03CA    8091                   ADL   TESTAIMX
    03CB    BA00  B8 2 00          NJP   $+X'0000'
    03CC    2C45  28 4 45          LDA  =X'0000' ,B
    03CD    122C  10 2 2C          LDC   $+X'002C'
    03CE    AE04  A8 6 04          STA   READY ,C
0404:       GO TO 300
0405: C
0406: C*****************************************************************************
0407: C

C                    VALVE STATUS DISPLAY
C
800     IF(.NOT. VTESTPB) GO TO 850
        IF(NVTEST .EQ. 0) GO TO 830
        IWINDOW=NVTEST
        I=N5
        GO TO 620
830     J=INDEX2+N4
        GO TO 860
850     J=INDEX2
860     TEMP=IIVGVSS(J)
        TEMP=TEMP/40.96
        IW(N5)=N3
C
C                    LOCATE DECIMAL POINT
C
900     IF(TEMP .GE. 0.) GO TO 910
        TEMP=-TEMP
        IW(N5)=N10
910     IF(TEMP .GL. 9999.) TEMP=9999.
        DO 930 I=N1,N4
        IF(TEMP .LT. XCHK(I)) GO TO 940
930     CONTINUE
940     INDEX3=5-I
        IWINDOW=XCHK(INDEX3+1)*TEMP+.001
950     I=N2
960     N=N4
```

```
0192: C
0193: C                    VALVE STATUS DISPLAY
0194: C
    0144    7572  70 5 72            JMP  *)900,B
0195: 800   IF(.NOT. VTESTPB) GO TO 850
```

---

```
    0145    1200  10 2 00   )800     LDC   $+X'0000'
    0146    2E12  28 6 12            LDA   VTESTPB ,C
    0147    5452  50 4 52            EOR  =X'FFFF' ,B
    0148    F200  F0 2 00            ZJP   $+X'0000'
    0149    7575  70 5 75            JMP  *)850,B
0196:       IF(NVTEST .EQ. 0) GO TO 830
    014A    12BD  10 2 BD            LDC   $+X'FFBD'
    014B    2E03  28 6 03            LDA   NVTEST,C
    014C    F201  F0 2 01            ZJP   $+X'0001'
    014D    7200  70 2 00            JMP   $+X'0000'
    014E    7576  70 5 76            JMP  *)830,B
0197:       IWINDOW=NVTEST
0198:       I=N5
0199:       GO TO 620
    014F    12B8  10 2 B8            LDC   $+X'FFB8'
    0150    2E03  28 6 03            LDA   NVTEST,C
    0151    AE06  A8 6 06            STA   IWINDOW ,C
    0152    2C49  28 4 49            LDA   N5,B
    0153    AC5C  A8 4 5C            STA   I ,B
    0154    7562  70 5 62            JMP  *)620,B
0200: 830   J=INDEX2+N4
0201:       GO TO 860
    0155    12B2  10 2 B2            LDC   $+X'FFB2'
    0156    2E05  28 6 05            LDA   INDEX2,C
    0157    440F  40 4 0F            ADD   N4,B
    0158    AC73  A8 4 73            STA   J ,B
    0159    7577  70 5 77            JMP  *)860,B
0202: 850   J=INDEX2
    015A    12AD  10 2 AD   )850     LDC   $+X'FFAD'
    015B    2E05  28 6 05            LDA   INDEX2,C
    015C    AC73  A8 4 73            STA   J ,B
0203: 860   TEMP=ITVGVSS(J)
0204:       TEMP=TEMP/40.96
0205:       IW(N5)=N3
```

```
0031: C
0032: C                    RESTORE SPEED CHANNEL SYSTEM
0033: C
0034: 55    LDA          =8913
    0000    0000                     DAT   X'0000'
    0001    0AFF  08 2 FF            LDB   $+X'FFFF'
    0005+B  22D1             )5
    0002    2C05  28 4 05            LDA  =X'22D1' ,B
0035: S     IOA          32
    0003    8820  88 0 20            IOA   X'0020'
0036: C
0037: C                    RESET ALL CCO'S AND A/O'S
0038: C
0039:       DO 20 I=1,32
```

---

```
    0007+B  0001
    0004    2C07  28 4 07          LDA   =X'0001' ,B
    0005    AC06  A8 4 06          STA    I ,B
00431       CALL M:CCO(N1,N0,I,MASK)
    0006    EF00  E8 7 00          SST   *M:CCO ,B
    0007    0002                   ADL    N1
    0008    0001                   ADL    N0
    0009    0006                   ADL    I
    000A    0004                   ADL    MASK
00411 20    CONTINUE
00420 -
```

We claim:

1. A control system for a large electric power steam turbine having a plurality of turbine sections to which steam is supplied through at least one throttle valve and a plurality of governor valves, said control system comprising means for electrohydraulically controlling the position of the throttle and governor valves, means for generating signals representative of the valve positions, means for generating signals representative of the turbine speed and the turbine impulse pressure, means for generating signals for application to said electrohydraulic controlling means to position the valves for speed control during startup in accordance with a predetermined characterization having a plurality of system parameters including a speed reference associated with it, means for generating signals for application to said electrohydraulic controlling means to position the valves for load control after synchronization in accordance with another predetermined characterization having a plurality of other system parameters including a load reference associated with it, said speed and load control generating means including means for generating respective speed and load demands from the speed and load references, an operator panel having a plurality of operator switch means to enable the operator to select the control system operating mode and the operating status of or value of or a display of other predetermined variables, said operator panel further including first means for displaying the reference value during speed control or load control and at least a second separate means for displaying the demand value during speed control or load control, said speed and load control generating means including means for generating display signals which are coupled to said display means, and means including at least one of said operator switch means for operating said control generating means and said display means to display at least one other parameter with at least one of said display means.

2. A steam turbine control system as set forth in claim 1 wherein a plurality of said switch means are provided to operate said control generating means and said display means to display respective additional parameters with at least one of said display means.

3. A steam turbine control system as set forth in claim 2 wherein the additional parameters are displayed with one of said display means and means are provided for generating a new value for any such parameter on display and for displaying the new value in the other of said display means, and means for registering new parameter values in said control generating means.

4. A steam turbine control system as set forth in claim 2 wherein the plurality of display switch means includes a group of display switch means associated respectively with a particular parameter and at least one display switch means associated with a group of parameters, and means for addressing particular parameters in said control generating means and for generating associated display signals when the parameter group display switch means is operated.

5. A steam turbine control system as set forth in claim 4 wherein respective display switch means are provided at least for the speed or load reference and the acceleration or load rate.

6. A steam turbine control system as set forth in claim 5 wherein respective display switch means are further provided for high and low load limits.

7. A steam turbine control system as set forth in claim 5 wherein a display switch means is further provided for valve position limit.

8. A steam turbine control system as set forth in claim 4 wherein said one group display switch means is for valve status, and means generating a valve status display signal representing the identification of a selected valve and the position of that valve when the valve status switch means is operated, and means for coupling the valve status display signal to at least one of said display means.

9. A steam turbine control system as set forth in claim 4 wherein said control generating means includes a digital computer which includes a programmed memory and which generates the signals for said electrohydraulic control means in accordance with the stored program and in accordance with input signals including the speed and impulse pressure signals and signals from said operator panel.

10. A steam turbine control system as set forth in claim 9 wherein means are provided for generating a signal representative of generated electrical load and for coupling the electric load signal to said computer.

11. A steam turbine control system as set forth in claim 9 wherein at least one of said display means includes means for generating a preselected mnemonic display associated with the parameter on display.

12. A steam turbine control system as set forth in claim 9 wherein display lamps are provided for predetermined variables including valve position limits and means are provided for flashing said display lamps when the associated variables reach a predetermined condition and specifically for flashing the valve position limit lamp when a valve position limit condition is exceeded.

13. A steam turbine control system as set forth in claim 12 wherein means are provided for generating a signal representative of throttle pressure and for coupling such signal to said computer, and means are further provided for flashing lamps associated with the high and low load limits and the throttle pressure.

* * * * *